US006963646B2

(12) United States Patent
Takagi et al.

(10) Patent No.: US 6,963,646 B2
(45) Date of Patent: Nov. 8, 2005

(54) SOUND SIGNAL ENCODING APPARATUS AND METHOD

(75) Inventors: Yoshiaki Takagi, Kanagawa-ken (JP); Yasuhito Watanabe, Kenagawa-ken (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 886 days.

(21) Appl. No.: 09/992,080

(22) Filed: Nov. 19, 2001

(65) Prior Publication Data

US 2002/0064284 A1 May 30, 2002

(30) Foreign Application Priority Data

Nov. 24, 2000 (JP) ..... 2000-358070

(51) Int. Cl.[7] ..... G10L 21/04

(52) U.S. Cl. ..... 381/23; 704/230; 704/200.01; 704/504

(58) Field of Search ..... 381/17, 18, 23; 704/200.01, 201, 229, 230, 504

(56) References Cited

U.S. PATENT DOCUMENTS 5,469,474 A * 11/1995 Kitabatake ..... 704/229
5,481,614 A * 1/1996 Johnston ..... 704/200.1
5,684,922 A * 11/1997 Miyakawa et al. ..... 704/229
5,736,943 A 4/1998 Herre et al.
6,456,968 B1 * 9/2002 Taniguchi et al. ..... 704/230

OTHER PUBLICATIONS

Bosi, M. et al., "ISO/IEC MPEG-2 Advanced Audio Coding", Journal of the Audio Engineering Society, Audio Engineering Society, New York, US, vol. 45, No. 10, Oct. 1, 1997, pp. 789-812, XP000730161.

Herre, J. et al., "Combined Stereo Coding", 93rd AES Convention 1992, Preprint 3369, 1992, pp. 1-18, XP009025132.

Herre, J. et al., "Intensity Stereo Coding", 96th AES Convention, 1994, Preprint 3799, 1994, pp. 1-10, XP009025131.

Johnston, J.D. et al., "Sum-difference Stereo Transform Coding", Digital Signal Processing 2, Estimation, VLSI. San Francisco, Mar. 23-26, 1992, Proceedings of the International Conference on Acoustics, Speech and Signal Processing (ICASSP), New York, IEEE, US, vol. 5, Conf. 17, Mar. 23, 1992, pp. 569-572, XP010058735.

* cited by examiner

*Primary Examiner*—Brian T. Pendleton
(74) *Attorney, Agent, or Firm*—Pearne & Gordon LLP

(57) ABSTRACT

A sound signal encoding apparatus for encoding two different sound signals, comprising: compression level calculating means for calculating a compression level for each of the sound signal sections; compression level judging means for judging whether or not the calculated compression level for each of the sound signal sections exceeds a predetermined threshold compression value; frequency components encoding means for encoding the quantized frequency components for each of the sound signal sections to a multiplexed bit stream with a predetermined bit rate under two different states consisting of the first state in which the frequency components for each of the sound signal sections are compressed by the first frequency components compressing means when the compression level judging means is operative to judge that the compression level for each of the sound signal sections exceeds the predetermined threshold compression value and the second state in which the frequency components for each of the sound signal sections are not compressed by the first frequency components compressing means when the compression level judging means is operative to judge that the compression level for each of the sound signal sections does not exceed the predetermined threshold compression value, the multiplexed bit stream with the predetermined bit rate being constituted by the sound signals for each of the sound signal sections and general information needed for the sound signals to be encoded and decoded.

17 Claims, 20 Drawing Sheets

SOUND SIGNAL ENCODING APPARATUS AND METHOD

BACKGROUND OF THE INVENTION

1. Technical Field of the Invention

The present invention relates to a sound signal encoding apparatus for and a sound signal encoding method of encoding and transmitting a sound signal, and more particularly to a sound signal encoding apparatus for and a sound signal encoding method of encoding and transmitting a sound signal such as a music sound signal data in a manner that the sound signal is encoded at a relatively high quality and smoothly transmitted to other electrically operating units via computer network.

2. Description of the Related Art

There have so far been proposed a wide variety of sound signal encoding apparatuses of this type one typical example of which is shown in FIG. 20. The conventional sound signal encoding apparatus comprises sound signals dividing means 101, first sound signal sections analyzing means 102, sampling rate selecting means 103, and sound signal sampling means 104. The sound signals dividing means 101 is operative to divide each of two different sound signals into a plurality of sound signal sections along a time axis for each of the sound signals to be taken for receiving therein. The sound signals consist of a first channel signal and a second channel signal. The first sound signal sections analyzing means 102 is designed to analyze each of the divided sound signal sections based on the sound signal characteristics inherent in the sound signal. The sampling rate selecting means 103 is adapted to select one arbitrary sampling rate for each of the sound signal sections from among predetermined sampling rates. The sound signal sampling means 104 is operative to sample each of the analyzed sound signal sections at the sampling rate selected by the sampling rate selecting means 104.

The conventional sound signal encoding apparatus further comprises second sound signal sections analyzing means 105, frequency components calculating means 106, and quantization bit numbers allocating means 107. The second sound signal sections analyzing means 105 is operative to analyze a masking threshold level for each of the divided sound signal sections based on a psycho acoustic model obtained by taking advantage of human's hearing characteristics.

The frequency components calculating means 106 is operative to calculate frequency components with two different information consisting of first and second signals for each of the sound signal sections sampled at the selected sampling rate, the above first signal being indicative of intensities, while the above second signal being indicative of frequencies. The quantization bit numbers allocating means 107 is designed to allocate quantization bit numbers for each of the calculated frequency components for each of the sound signal sections.

The conventional sound signal encoding apparatus further comprises first frequency components compressing means 108, and second frequency components compressing means 109. The first frequency components compressing means 108 is adapted to compress the frequency components for each of the sound signal sections with two different information consisting of first and second signals. The second frequency components compressing means 109 is operative to compress the frequency components for each of the sound signal sections with two different information consisting of first and second signals. The above first signal is indicative of the addition of each of the frequency components for the first channel signal and each of the frequency components for the second channel signal, while the above second signal is indicative of the difference between each of the frequency components for the first channel signal and each of the frequency components for the second channel signal.

The conventional sound signal encoding apparatus further comprises frequency components quantizing means 110 and frequency components encoding means 111. The frequency components quantizing means 110 is operative to quantize each of the frequency components for each of the sound signal sections at the predetermined quantization bit numbers. The frequency components encoding means 111 is operative to encode the quantized frequency components for each of the sound signal sections to a multiplexed bit stream. The multiplexed bit stream is constituted by the sound signals for each of the sound signal sections and general information needed for the sound signals to be encoded and decoded.

The sound signal is encoded by the conventional sound signal encoding apparatus in accordance with the MPEG2 AAC (Advanced Audio Coding) decided by the Motion Picture Experts Group, and is then transmitted at a predetermined transmitting bit rate to other electrically operating units via computer network.

The conventional sound signal encoding apparatus thus constructed in the above encounters such a problem that the sound signal tends to be encoded at a relatively low quality. The reason is due to the fact that the first frequency components compressing means 108 is operative to compress the frequency components for each of the sound signal sections with two different information consisting of the first and second signals. The above second signal is intended to indicate the intensity ratio of one of the frequency components for the first channel signal and the frequency components for the second channel signal to the other of the frequency components for the first channel signal and the frequency components for the second channel signal. The compression of the sound signal thus performed by the first frequency components compressing means 108 results in an excessive compression to the sound signal, and contributing to a wasteful load to computers building the network and deteriorating a music sound quality when the sound signal is decoded.

SUMMARY OF THE INVENTION

It is, therefore, an object of the present invention to provide a sound signal encoding apparatus which can prevent the quality of the decoded sound signal from deteriorating resulting from the excessive compression to the sound signal.

It is another object of the present invention to provide a delivery system for delivering sound signal data related to a music at a relatively high quality irrespective of either the compressed sound signal or the non-compressed sound signal.

The one aspect of the sound signal encoding apparatus according to present invention comprises sound signals dividing means for dividing each of the two different sound signals into a plurality of sound signal sections along a time axis for each of the sound signals to be taken for receiving therein, the sound signals consisting of a first channel signal and a second channel signal; first sound signal sections analyzing means for analyzing each of the divided sound signal sections based on the sound signal characteristics inherent in the sound signal; sampling rate selecting means for selecting one arbitrary sampling rate for each of the analyzed sound signal sections from among predetermined sampling rates; sound signal sampling means for sampling each of the analyzed sound signal sections at the sampling rate selected by the sampling rate selecting means; second sound signal sections analyzing means for analyzing each of the divided sound signal sections based on a psycho acoustic model obtained by taking advantage of human's hearing characteristics; frequency components calculating means for calculating frequency components with two different information consisting of first and second signals for each of the sound signal sections sampled at the selected sampling rate, the above first signal being indicative of intensities, and the above second signal being indicative of frequencies; quantization bit numbers allocating means for allocating quantization bit numbers for each of the calculated frequency components for each of the sound signal sections; compression level calculating means for calculating a compression level for each of the sound signal sections; compression level judging means for judging whether or not the calculated compression level for each of the sound signal sections exceeds a predetermined threshold compression value; first frequency components compressing means for compressing the frequency components for each of the sound signal sections with two different information consisting of first and second signals, the above first signal being indicative of the intensities and the above second signal being indicative of ratio of one of the frequency components for the first channel signal and the frequency components for the second channel signal to the other of the frequency components for the first channel signal and the frequency components for the second channel signal; second frequency components compressing means for compressing the frequency components for each of the sound signal sections with two different information consisting of first and second signals, the above first signal being indicative of the addition of each of the frequency components for the first channel signal and each of the frequency components for the second channel signal, and the above second signal being indicative of the difference between each of the frequency components for the first channel signal and each of the frequency components for the second channel signal; frequency components quantizing means for quantizing each of the frequency components for each of the sound signal sections at predetermined quantization bit numbers under two different states consisting of a first state in which the frequency components for each of the sound signal sections are compressed by the first frequency components compressing means when the compression level judging means is operative to judge that the compression level for each of the sound signal sections exceeds the predetermined threshold compression value and a second state in which the frequency components for each of the sound signal sections are not compressed by the first frequency components compressing means when the compression level judging means is operative to judge that the compression level for each of the sound signal sections does not exceed the predetermined threshold compression value; and frequency components encoding means for encoding the quantized frequency components for each of the sound signal sections to a multiplexed bit stream with a predetermined bit rate under two different states consisting of the first state in which the frequency components for each of the sound signal sections are compressed by the first frequency components compressing means when the compression level judging means is operative to judge that the compression level for each of the sound signal sections exceeds the predetermined threshold compression value and the second state in which the frequency components for each of the sound signal sections are not compressed by the first frequency components compressing means when the compression level judging means is operative to judge that the compression level for each of the sound signal sections does not exceed the predetermined threshold compression value, the multiplexed bit stream with the predetermined bit rate being constituted by the sound signals for each of the sound signal sections and general information needed for the sound signals to be encoded and decoded.

The another aspect of the sound signal encoding apparatus according to present invention comprises sound signals dividing means for dividing each of the two different sound signals into a plurality of sound signal sections along a time axis for each of the sound signals to be taken for receiving therein, the sound signals consisting of a first channel signal and a second channel signal; first sound signal sections analyzing means for analyzing each of the divided sound signal sections based on the sound signal characteristics inherent in the sound signal; sampling rate selecting means for selecting one arbitrary sampling rate for each of the analyzed sound signal sections from among predetermined sampling rates; sound signal sampling means for sampling each of the divided sound signal sections at the sampling rate selected by the sampling rate selecting means; second sound signal sections analyzing means for analyzing each of the divided sound signal sections based on a psycho acoustic model obtained by taking advantage of human's hearing characteristics; frequency components calculating means for calculating frequency components with two different information consisting of first and second signals for each of the sound signal sections sampled at the selected sampling rate, the above first signal being indicative of intensities, and the above second signal being indicative of frequencies; quantization bit numbers allocating means for allocating quantization bit numbers for each of the calculated frequency components for each of the sound signal sections; energy ratio calculating means for calculating an energy ratio for each of the sound signal sections; energy ratio judging means for judging whether or not the energy ratio for each of the sound signal sections exceeds a predetermined threshold energy value; first frequency components compressing means for compressing the frequency components for each of the sound signal sections with two different information consisting of first and second signals, the above first signal being indicative of the intensities and the above second signal being indicative of ratio of one of the frequency components for the first channel signal and the frequency components for the second channel signal to the other of the frequency components for the first channel signal and the frequency components for the second channel signal; second frequency components compressing means for compressing the frequency components for each of the sound signal sections with two different information consisting of first and second signals, the above first signal being indicative of the addition of each of the frequency components for the first channel signal and each of the frequency components for the second channel signal, and the above second signal being indicative of the difference between each of the frequency components for the first channel signal and each of the frequency components for the second channel signal; frequency components quantizing means for quantizing each of the frequency components for each of the sound signal sections at predetermined quantization bit numbers under two different states consisting of a first state in which the frequency components for each of the sound signal sections are compressed by the first frequency components compressing means when the energy ratio judging means is operative to judge that the energy ratio for each of the sound signal sections exceeds the predetermined threshold energy value and a second state in which the frequency components for each of the sound signal sections are not compressed by the first frequency components compressing means when the energy ratio judging means is operative to judge that the energy ratio for each of the sound signal sections does not exceed the predetermined threshold energy value; and frequency components encoding means for encoding the quantized frequency components for each of the sound signal sections to a multiplexed bit stream with a predetermined bit rate under two different states consisting of the first state in which the frequency components for each of the sound signal sections are compressed by the first frequency components compressing means when the energy ratio judging means is operative to judge that the energy ratio for each of the sound signal sections exceeds the predetermined threshold energy value and the second state in which the frequency components for each of the sound signal sections are not compressed by the first frequency components compressing means when the energy ratio judging means is operative to judge that the energy ratio for each of the sound signal sections does not exceed the predetermined threshold energy value, the multiplexed bit stream with the predetermined bit rate being constituted by the sound signals for each of the sound signal sections and general information needed for the sound signals to be encoded and decoded.

The further aspect of the sound signal encoding apparatus according to present invention comprises sound signals dividing means for dividing each of the two different sound signals into a plurality of sound signal sections along a time axis for each of the sound signals to be taken for receiving therein, the sound signals consisting of a first channel signal and a second channel signal; first sound signal sections analyzing means for analyzing each of the divided sound signal sections based on the sound signal characteristics inherent in the sound signal; sampling rate selecting means for selecting one arbitrary sampling rate for each of the analyzed sound signal sections from among predetermined sampling rates; sound signal sampling means for sampling each of the divided sound signal sections at the sampling rate selected by the sampling rate selecting means; second sound signal sections analyzing means for analyzing each of the divided sound signal sections based on a psycho acoustic model obtained by taking advantage of human's hearing characteristics; frequency components calculating means for calculating frequency components with two different information consisting of first and second signals for each of the sound signal sections sampled at the selected sampling rate, the above first signal being indicative of intensities, and the above second signal being indicative of frequencies; quantization bit numbers allocating means for allocating quantization bit numbers for each of the calculated frequency components for each of the sound signal sections; compression level calculating means for calculating a compression level for each of the sound signal sections; threshold energy value selecting means for selecting one arbitrary threshold energy value for each of the sound signal sections from among predetermined threshold energy values based on the compression level calculated by the compression level calculating means; energy ratio calculating means for calculating an energy ratio for each of the sound signal sections; energy ratio judging means for judging whether or not the energy ratio for each of the sound signal sections exceeds the threshold energy value selected by the threshold energy value selecting means; first frequency components compressing means for compressing the frequency components for each of the sound signal sections with two different information consisting of first and second signals, the above first signal being indicative of the intensities and the above second signal being indicative of ratio of one of the frequency components for the first channel signal and the frequency components for the second channel signal to the other of the frequency components for the first channel signal and the frequency components for the second channel signal; second frequency components compressing means for compressing the frequency components for each of the sound signal sections with two different information consisting of first and second signals, the above first signal being indicative of the addition of each of the frequency components for the first channel signal and each of the frequency components for the second channel signal, and the above second signal being indicative of the difference between each of the frequency components for the first channel signal and each of the frequency components for the second channel signal; frequency components quantizing means for quantizing each of the frequency components for each of the sound signal sections at predetermined quantization bit numbers under two different states consisting of a first state in which the frequency components for each of the sound signal sections are compressed by the first frequency components compressing means when the energy ratio judging means is operative to judge that the energy ratio for each of the sound signal sections exceeds the selected threshold energy value and a second state in which the frequency components for each of the sound signal sections are not compressed by the first frequency components compressing means when the energy ratio judging means is operative to judge that the energy ratio for each of the sound signal sections does not exceed the selected threshold energy value; and frequency components encoding means for encoding the quantized frequency components for each of the sound signal sections to a multiplexed bit stream with a predetermined bit rate under two different states consisting of the first state in which the frequency components for each of the sound signal sections are compressed by the first frequency components compressing means when the energy ratio judging means is operative to judge that the energy ratio for each of the sound signal sections exceeds the selected threshold energy value and the second state in which the frequency components for each of the sound signal sections are not compressed by the first frequency components compressing means when the energy ratio judging means is operative to judge that the energy ratio for each of the sound signal sections does not exceed the selected threshold energy value, the multiplexed bit stream with the predetermined bit rate being constituted by the sound signals for each of the sound signal sections and general information needed for the sound signals to be encoded and decoded.

The still further aspect of the sound signal encoding apparatus according to present invention comprises a sound signals dividing step of dividing each of the two different sound signals into a plurality of sound signal sections along a time axis for each of the sound signals to be taken for receiving therein, the sound signals consisting of a first channel signal and a second channel signal; a first sound signal sections analyzing step of analyzing each of the divided sound signal sections based on the sound signal characteristics inherent in the sound signal; a sampling rate selecting step of selecting one arbitrary sampling rate for each of the analyzed sound signal sections from among predetermined sampling rates; a sound signal sampling step of sampling each of the analyzed sound signal sections at the sampling rate selected by the sampling rate selecting step; a second sound signal sections analyzing step of analyzing each of the divided sound signal sections based on a psycho acoustic model obtained by taking advantage of human's hearing characteristics; a frequency components calculating step of calculating frequency components with two different information consisting of first and second signals for each of the sound signal sections sampled at the selected sampling rate, the above first signal being indicative of intensities, and the above second signal being indicative of frequencies; a quantization bit numbers allocating step of allocating quantization bit numbers for each of the calculated frequency components for each of the sound signal sections; a compression level calculating step of calculating a compression level for each of the sound signal sections; a compression level judging step of judging whether or not the compression level for each of the sound signal sections exceeds the predetermined threshold compression value; a first frequency components compressing step of compressing the frequency components for each of the sound signal sections with the two different information consisting of the first and second signals, the above first signal being indicative of the intensity and the above second signal being indicative of ratio of one of the frequency components for the first channel signal and the frequency components for the second channel signal to the other of the frequency components for the first channel signal and the frequency components for the second channel signal; a second frequency components compressing step of compressing the frequency components for each of the sound signal sections with two different information consisting of the first and second signals, the above first signal being indicative of the addition of each of the frequency components for the first channel signal and each of the frequency components for the second channel signal, and the above second signal being indicative of the difference between each of the frequency components for the first channel signal and each of the frequency components for the second channel signal; a frequency components quantizing step of quantizing each of the frequency components for each of the sound signal sections at the predetermined quantization bit numbers under the two different states consisting of the first state in which the frequency components for each of the sound signal sections are compressed by the first frequency components compressing step when the compression level judging step is operative to judge that the compression level for each of the sound signal sections exceeds the predetermined threshold compression value and the second state in which the frequency components for each of the sound signal sections are not compressed by the first frequency components compressing step when the compression level judging step is operative to judge that the compression level for each of the sound signal sections does not exceed the predetermined threshold compression value; and a frequency components encoding step of encoding the quantized frequency components for each of the sound signal sections to the multiplexed bit stream with the predetermined bit rate under the two different states consisting of the first state in which the frequency components for each of the sound signal sections are compressed by the first frequency components compressing step when the compression level judging step is operative to judge that the compression level for each of the sound signal sections exceeds the predetermined threshold compression value and the second state in which the frequency components for each of the sound signal sections are not compressed by the first frequency components compressing step when the compression level judging step is operative to judge that the compression level for each of the sound signal sections does not exceed the predetermined threshold compression value, the multiplexed bit stream with the predetermined bit rate being constituted by the sound signals for each of the sound signal sections and general information needed for the sound signals to be encoded and decoded.

BRIEF DESCRIPTION OF THE DRAWINGS

The objects, features and advantages of the present invention will become apparent as the description proceeds when taken in conjunction with the accompanying drawings, in which.

DESCRIPTION OF THE PREFERRED EMBODIMENTS

The embodiments of the sound signal encoding apparatus according to the present invention will be described in detail hereinafter.

Figure 1:
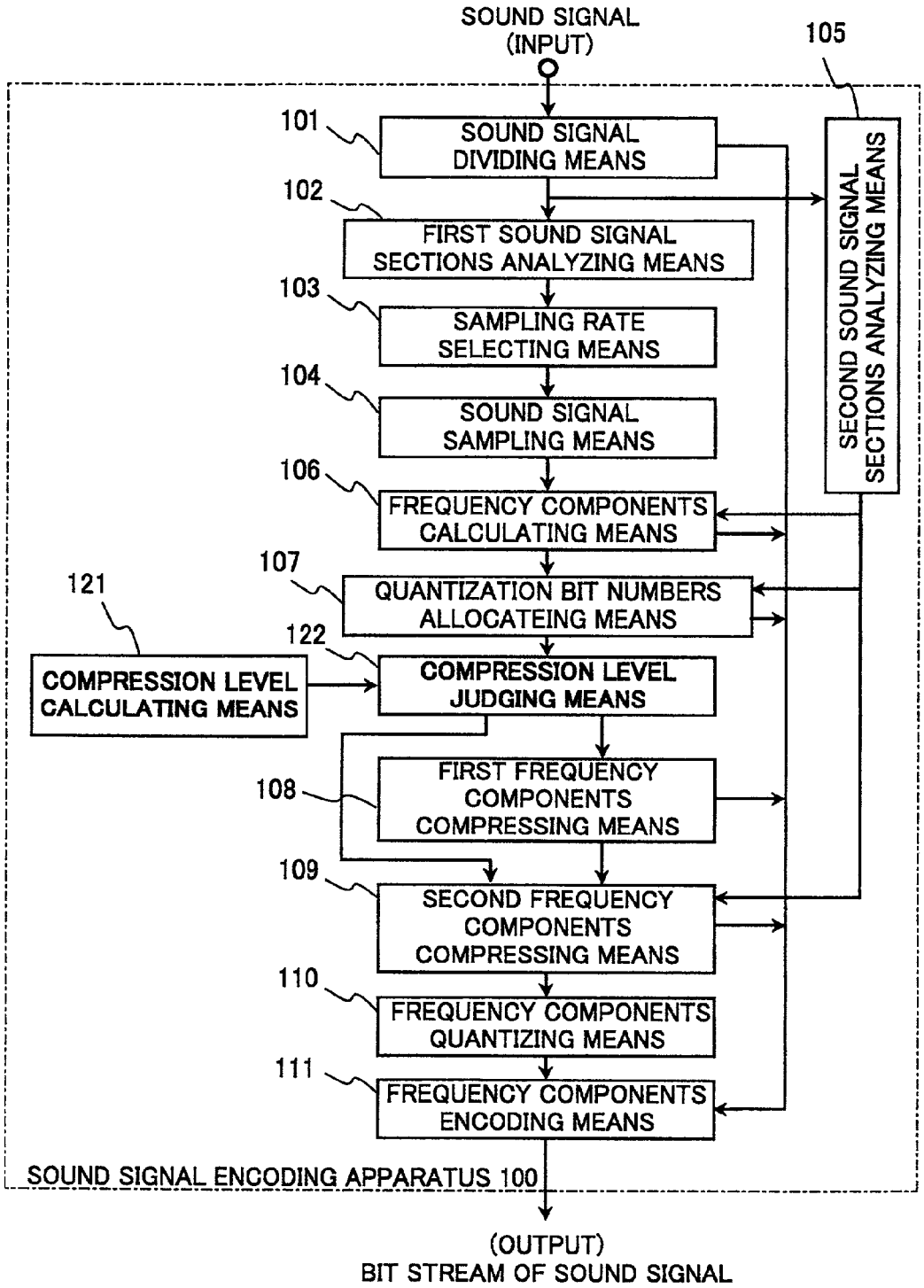
FIG. 1 is a block diagram of the first embodiment according to the present invention.
Figure 20:
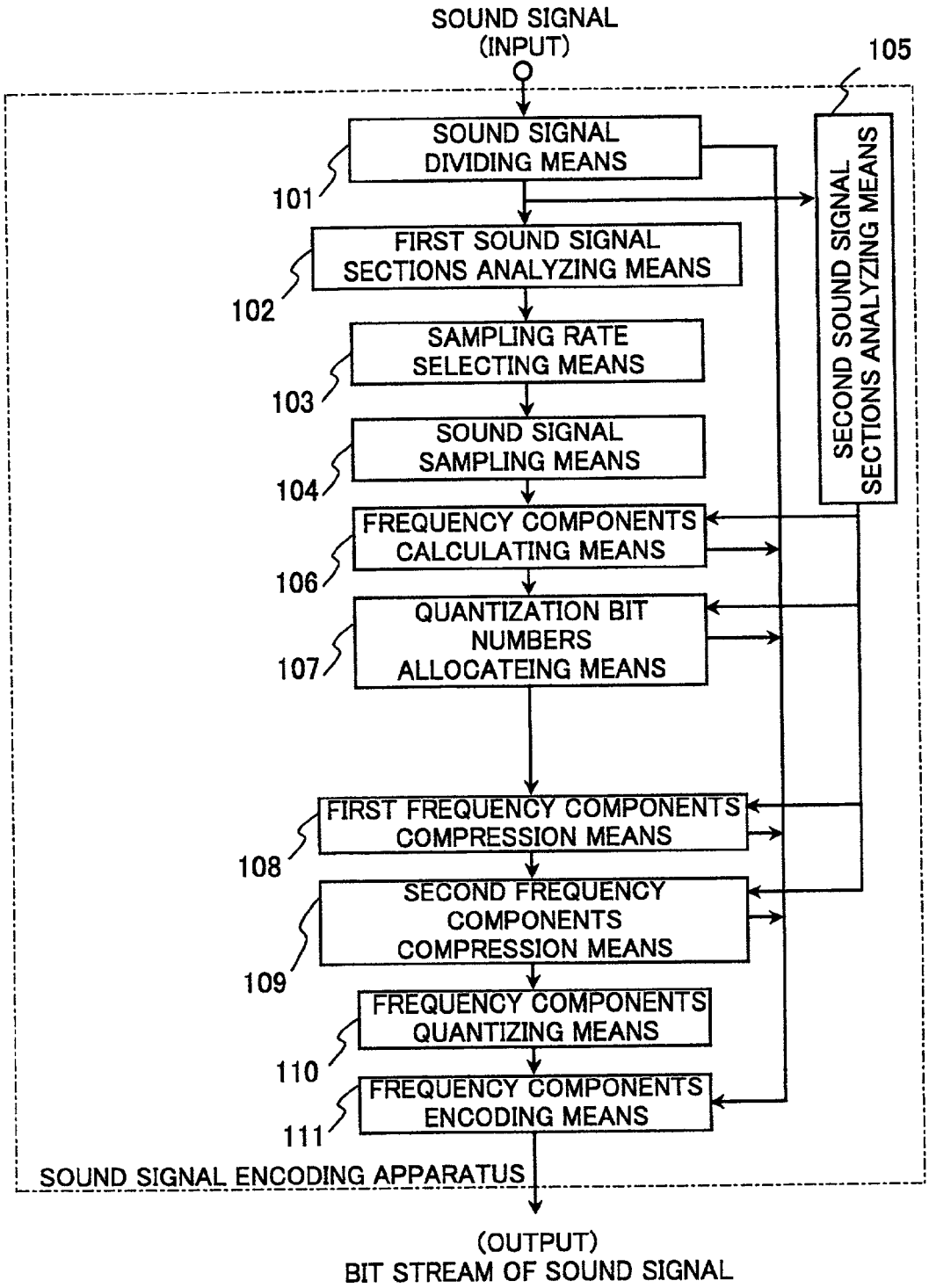
FIG. 20 is a block diagram of the conventional sound signal encoding apparatus.

The first embodiment of the sound signal encoding apparatus 100 according to the present invention is shown in FIG. 1 as partly similar in construction to the conventional sound signal encoding apparatus shown in FIG. 20 and thus comprises sound signals dividing means 101, first sound signal sections analyzing means 102, sampling rate selecting means 103, and sampling rate selecting means 104. The sound signals dividing means 101 is operative to divide each of two different sound signals into a plurality of sound signal sections along the time for each of the sound signals to be taken for receiving therein. The sound signals consist of a first channel signal and a second channel signal.

Figure 13:
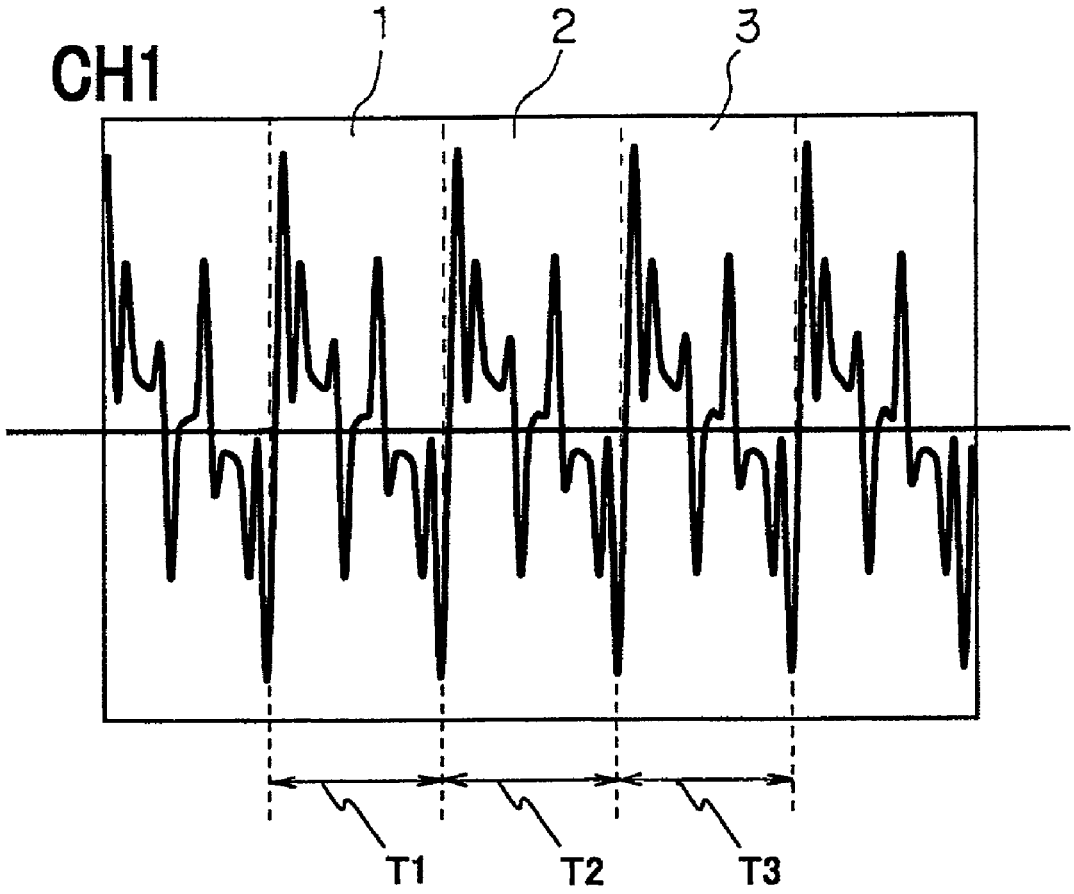
FIG. 13 is a diagram showing the fluctuation of the sound signal in the first channel of the two channel sound signals.
Figure 14:
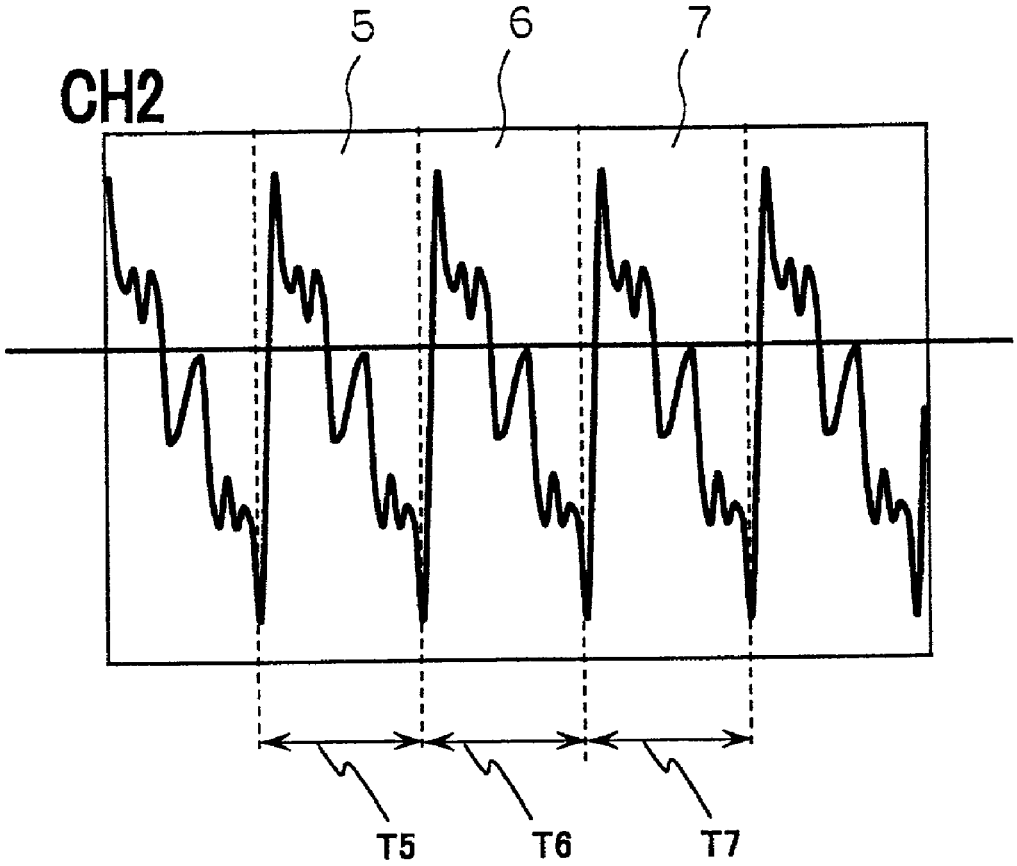
FIG. 14 is a diagram showing the fluctuation of the sound signal in the second channel of the two channel sound signals.

The sound signals thus inputted to the sound signal encoding apparatus 100 include first and second channel signals represented by reference legends "CH1" and "CH2", respectively, as shown in FIGS. 13 and 14. Each of the two different sound signals CH1 and CH2 is divided into a plurality of sound signal sections along a time axis for each of the sound signals to be taken for receiving therein. Each of the sound signal sections for the first channel signal CH1 is sequentially represented by reference numbers 1 to 3 as shown in FIG. 13. The time width of each of the sound signal sections 1 to 3 for the first channel signal CH1 is sequentially represented by the reference legends "T1", "T2", and "T3". It is therefore to be understood that the sound signal sections 1 to 3 are respectively divided within the time intervals T1, T2, and T3.

Similarly to the division of the first channel signal CH1, the division of the second channel signal CH2 is performed as follows.

Each of the sound signal sections for the second channel signal CH2 is sequentially represented by reference numbers 5 to 7 as shown in FIG. 14. The time width of Each of the sound signal sections 5 to 7 for the second channel signal CH2 is sequentially represented by the reference legends "T5", "T6", and "T7". It is therefore to be understood that the sound signal sections 5 to 7 are respectively divided within the time intervals T5, T6, and T7. Each of the divided sound signal sections of the two different sound signals CH1 and CH2 is respectively shown in FIGS. 15 and 16.

The first sound signal sections analyzing means 102 is adapted to analyze each of the divided sound signal sections 1 to 3 for the second channel signal CH1 and the divided sound signal sections 5 to 7 for the second channel signal CH2 based on the sound signal characteristics inherent in the sound signal. The sampling rate selecting means 103 is adapted to select one arbitrary sampling rate for each of the sound signal sections from among predetermined sampling rates based on each of the sound signal sections analyzed by the first sound signal analyzing means 102. The sound signal sampling means 104 is adapted to sample each of the sound signal sections at the selected sampling rate.

Figure 15:
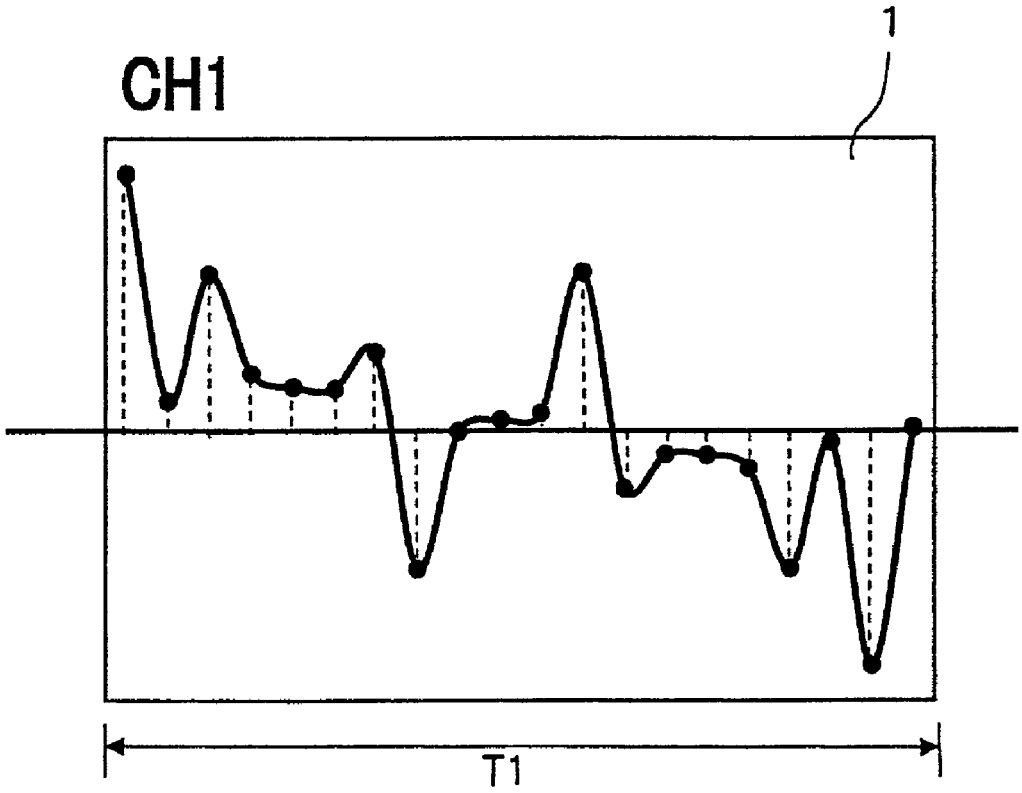
FIG. 15 is a diagram showing the fluctuation of the sound signal in the first channel of the two channel sound signals.

Each of the divided sound signal sections 1 to 3 for the first channel signal CH1 is sequentially sampled at the selected sampling rate as shown in FIG. 15.

Similarly to the division of the first channel signal CH1, the division of the second channel signal CH2 is performed as follows.

Figure 16:
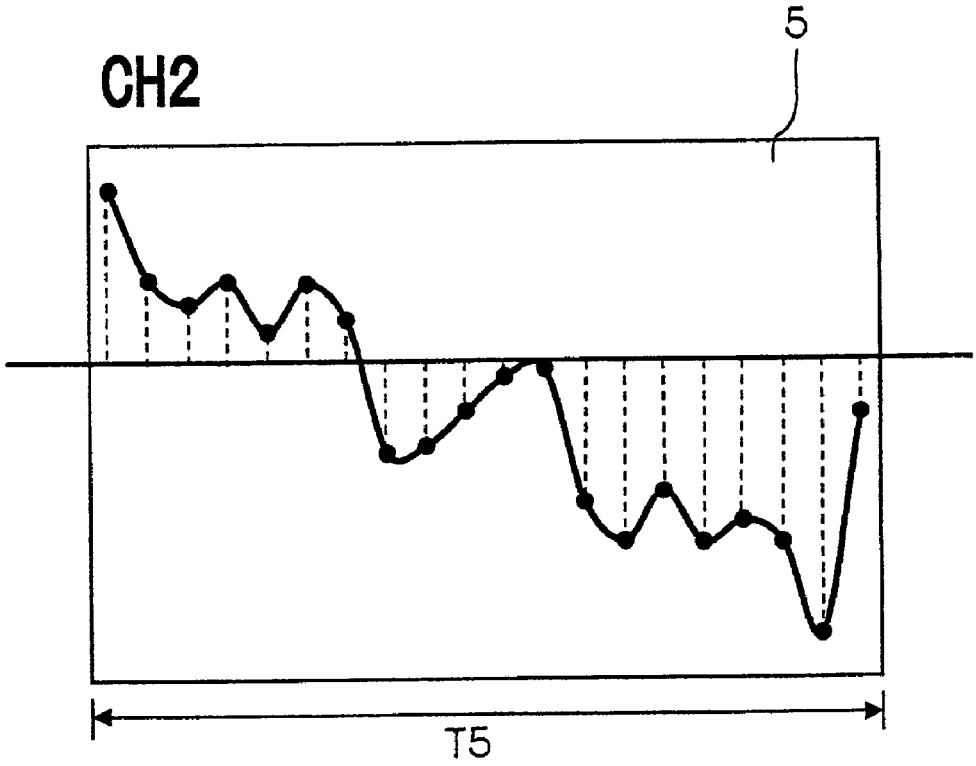
FIG. 16 is a diagram showing the fluctuation of the sound signal in the second channel of the two channel sound signals.
Figure 17:
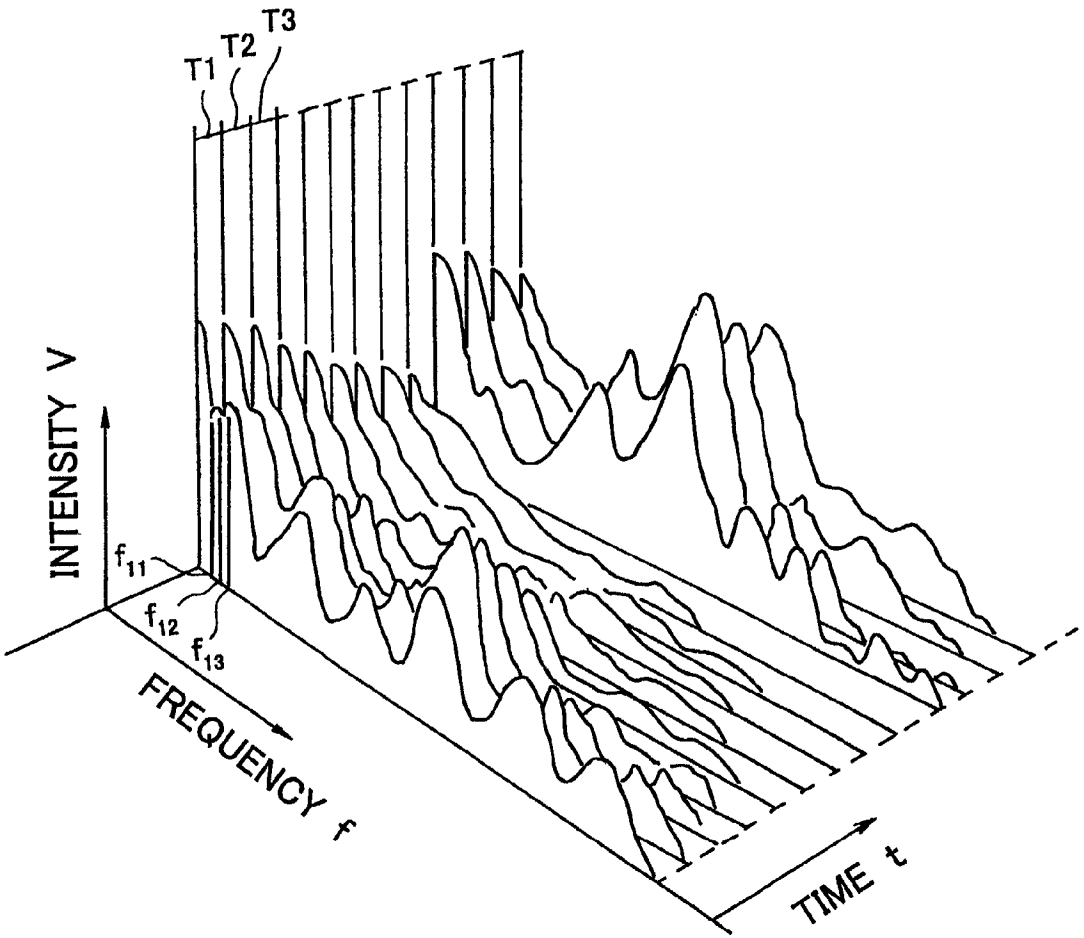
FIG. 17 is a diagram showing the fluctuated waves of the frequency components in the first channel of the two channel sound signals.
Figure 18:
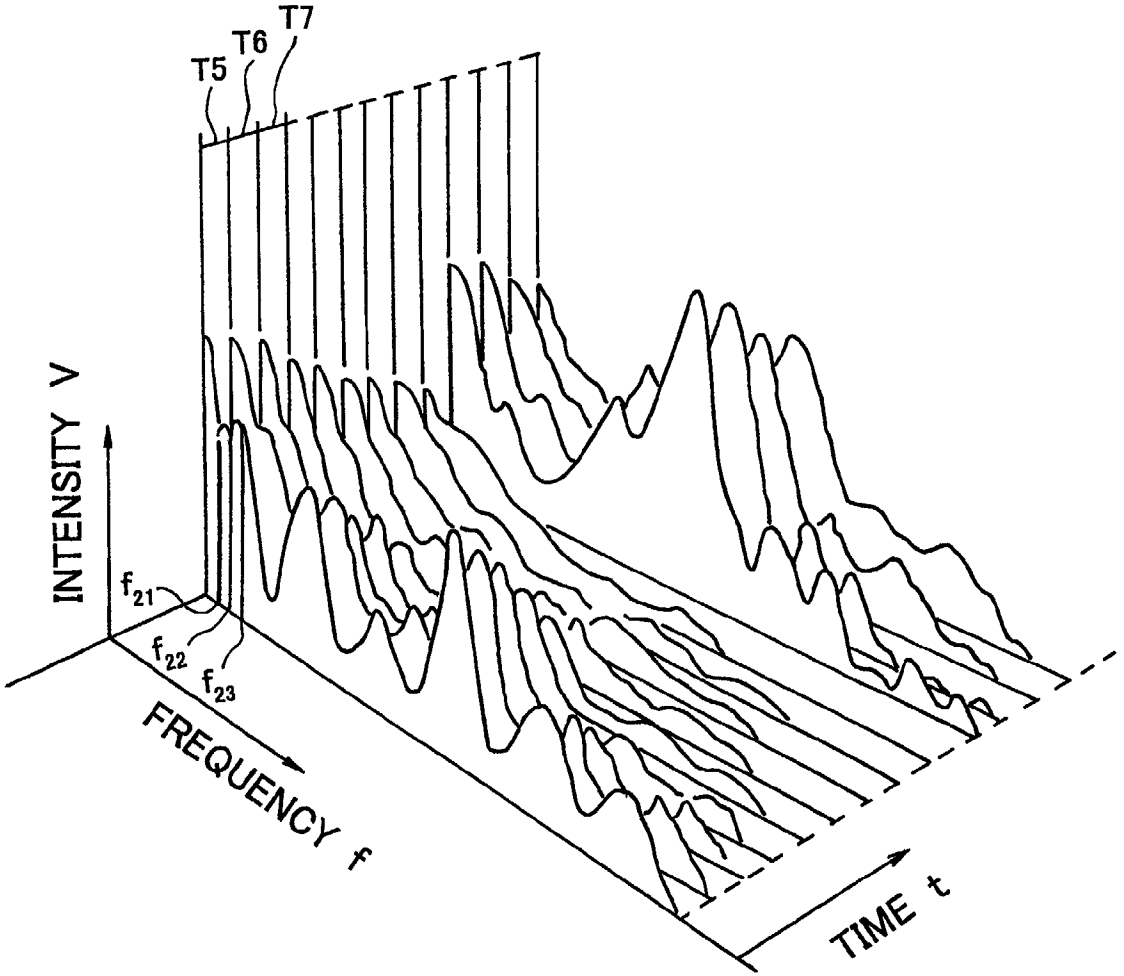
FIG. 18 is a diagram showing the fluctuated waves of the frequency components in the second channel of the two channel sound signals.
Figure 19:
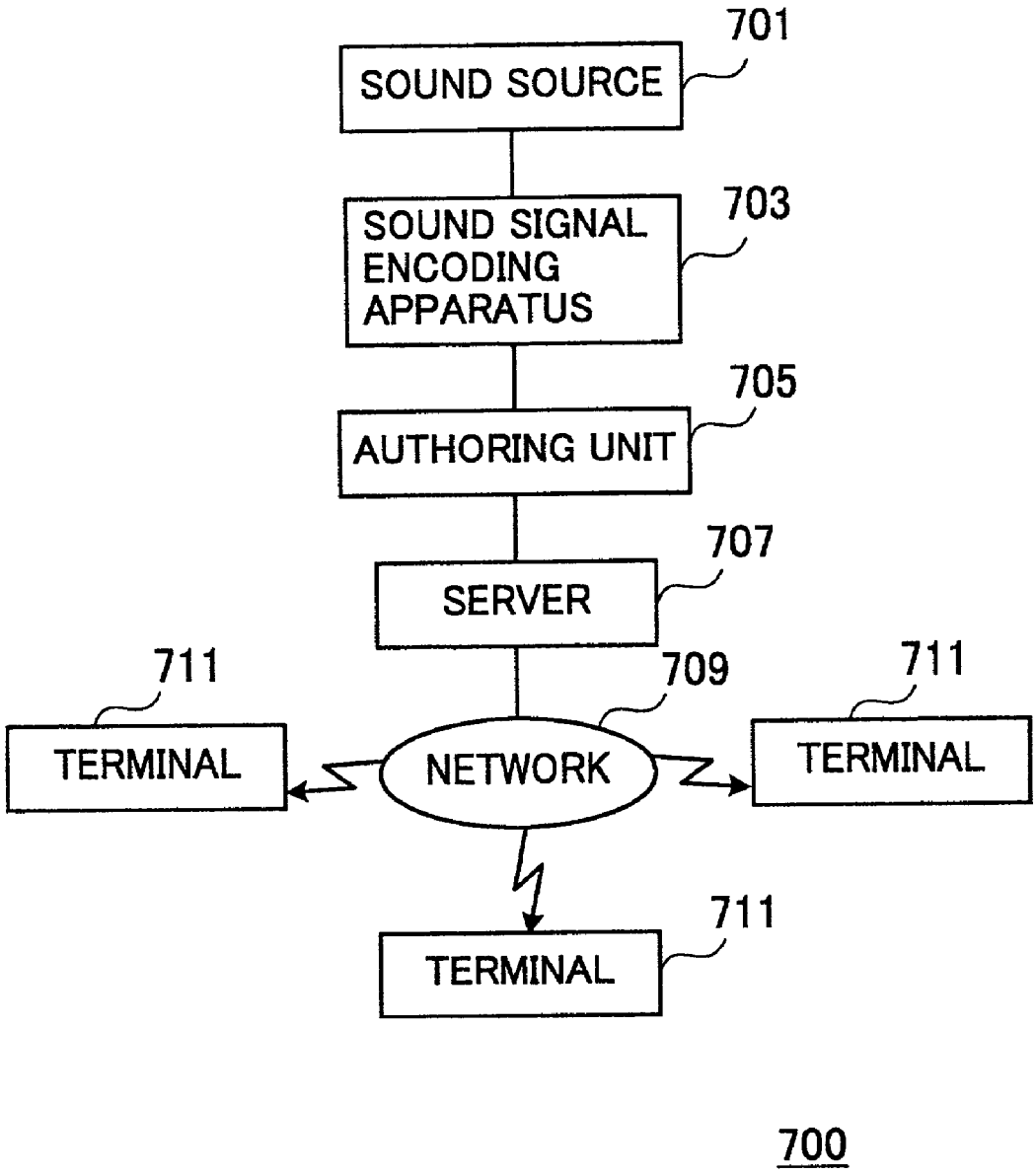
FIG. 19 is a block diagram of the music delivery system according to the present invention.

Each of the divided sound signal sections 5 to 7 for the second channel signal CH2 is sequentially sampled at the selected sampling rate as shown in FIG. 16.

The sound signal encoding apparatus 100 further comprises second sound signal sections analyzing means 105, frequency components calculating means 106, and quantization bit numbers allocating means 107. The second sound signal sections analyzing means 105 is operative to analyze each of the sound signal sections based on a psycho acoustic model obtained by taking advantage of human's hearing characteristics. The frequency components calculating means 105 is operative to calculate the frequency components for each of the sound signal sections sampled at the selected sampling rate based on the Modified Discrete Cosine Transformation.

Each of the frequency components for the sound signal sections 1 is represented by the reference legends "f11", "f12", and "f1n".

Similarly to the division of the first channel signal CH1, the division of the second channel signal CH2 is performed as follows.

Each of the frequency components for the sound signal sections 2 is represented by the reference legends "f21", "f22", and "f2n".

The quantization bit numbers allocating means 106 is operative to allocate quantization bit numbers for each of the calculated frequency components for each of the sound signal sections of both the first channel signal CH1 and the second channel signal CH2 based on the second sound signal sections analyzing means 105.

The sound signal encoding apparatus 100 further comprises compression level calculating means 121 and compression level judging means 122. The compression level calculating means 121 is operative to calculate the compression level for each of the sound signal sections. The compression level judging means 122 is operative to judge whether or not the compression level for each of the sound signal sections exceeds a predetermined threshold compression value. The compression level judging means 122 has a flag with two different states consisting of the first state in which the frequency components for each of the sound signal sections are compressed by the first frequency components compressing means 108 when the compression level judging means 122 is operative to judge that the compression level for each of the sound signal sections exceeds the predetermined threshold compression value and the second state in which the frequency components for each of the sound signal sections are not compressed by the first frequency components compressing means 108 when the compression level judging means 122 is operative to judge that the compression level for each of the sound signal sections does not exceed the predetermined threshold compression value.

The sound signal encoding apparatus 100 further comprises first frequency components compressing means 107 and second frequency components compressing means 108. The first frequency components compressing means 107 is operative to compress the frequency components f11, f12, and f1*n* (n=1 to N) for each of the sound signal sections 1 and the frequency components f21, f22, and f2*n* (n=1 to N) for each of the sound signal sections 2 with two different information consisting of first and second signals based on the second sound signal section analyzing means 105. The above first signal is indicative of the intensity signal based on both each of the frequency components f11, f12, and f1*n* (n=1 to N) for the first channel signal CH1 and each of the frequency components f21, f22, and f2*n* (n=1 to N) for the second channel signal CH2. The above second signals is indicative of ratio of one of the frequency components f11, f12, and f1*n* (n=1 to N) for the first channel signal CH1 and the frequency components f21, f22, and f2*n* (n=1 to N) for the second channel signal CH2 to the other of the frequency components f11, f12, and f1*n* (n=1 to N) for the first channel signal CH1 and the frequency components f21, f22, and f2*n* (n=1 to N) for the second channel signal CH2.

The second frequency components compressing means 108 is operative to compress the frequency components f11, f12, and f1*n* (n=1 to N) for each of the sound signal sections 1 and the frequency components f21, f22, and f2*n* (n=1 to N)

for each of the sound signal sections 2 with two different information consisting of a first and second signals based on the second sound signal section analyzing means 105. The above first signal is indicative of the addition f11+f21, f12+f22, and f1*n*+f2*n* (n=1 to N) for each of the frequency components f11, f12, and f1*n* (n=1 to N) for the first channel signal CH1 and each of the frequency components f21, f22, and f2*n* (n=1 to N) for the second channel signal CH2, and while the above second signal being indicative of the difference f11−f21, f12−f22, and f1*n*−f2*n* (n=1 to N) between each of the frequency components f11, f12, and f1*n* (n=1 to N) for the first channel signal CH1 and each of the frequency components f21, f22, and f2*n* (n=1 to N) for the second channel signal CH2.

The sound signal encoding apparatus 100 further comprises frequency components quantizing means 109 and frequency components encoding means 110. The frequency components quantizing means 109 is operative to quantize both the frequency components f11, f12, and f1*n* (n=1 to N) for each of the sound signal sections of the first channel signal CH1 and the frequency components f21, f22, and f2*n* (n=1 to N) for each of the sound signal sections of the second channel signal CH2 at the predetermined quantization bit numbers based on the second sound signal sections analyzing means 105 under two different states consisting of a first state in which the frequency components f11, f12, and f1*n* (n=1 to N) for each of the sound signal sections of the first channel signal CH1 and the frequency components f21, f22, and f2*n* (n=1 to N) for each of the sound signal sections of the second channel signal CH2 are compressed by the first frequency components compressing means 107 when the compression level judging means 122 is operative to judge that the compression level for each of the sound signal sections exceeds the predetermined threshold compression value, and a second state in which the frequency components f11, f12, and f1*n* (n=1 to N) for each of the sound signal sections of the first channel signal CH1 and the frequency components f21, f22, and f2*n* (n=1 to N) for each of the sound signal sections of the second channel signal CH2 are not compressed by the first frequency components compressing means 107 when the compression level judging means 122 is operative to judge that the compression level for each the sound signal sections does not exceed the predetermined threshold compression value.

The frequency components encoding means 110 is operative to encode the quantized frequency components for each of the sound signal sections of both the first channel signal CH1 and the second channel signal CH2 to a multiplexed bit stream under two different states consisting of the first state in which the sound signals for the sound signal sections are compressed by the first frequency components compressing means 107 when the compression level judging means 122 is operative to judge that the compression level for each of the sound signal sections exceeds the predetermined threshold compression value and the second state in which the frequency components for the sound signal sections are compressed by the first frequency components compressing means 107 when the compression level judging means 122 is operative to judge that the compression level for each of the sound signal sections does not exceed the predetermined threshold compression value, the multiplexed bit stream being constituted by the sound signals for each of the sound signal sections and general information needed for the sound signals to be encoded and decoded.

Figure 7:
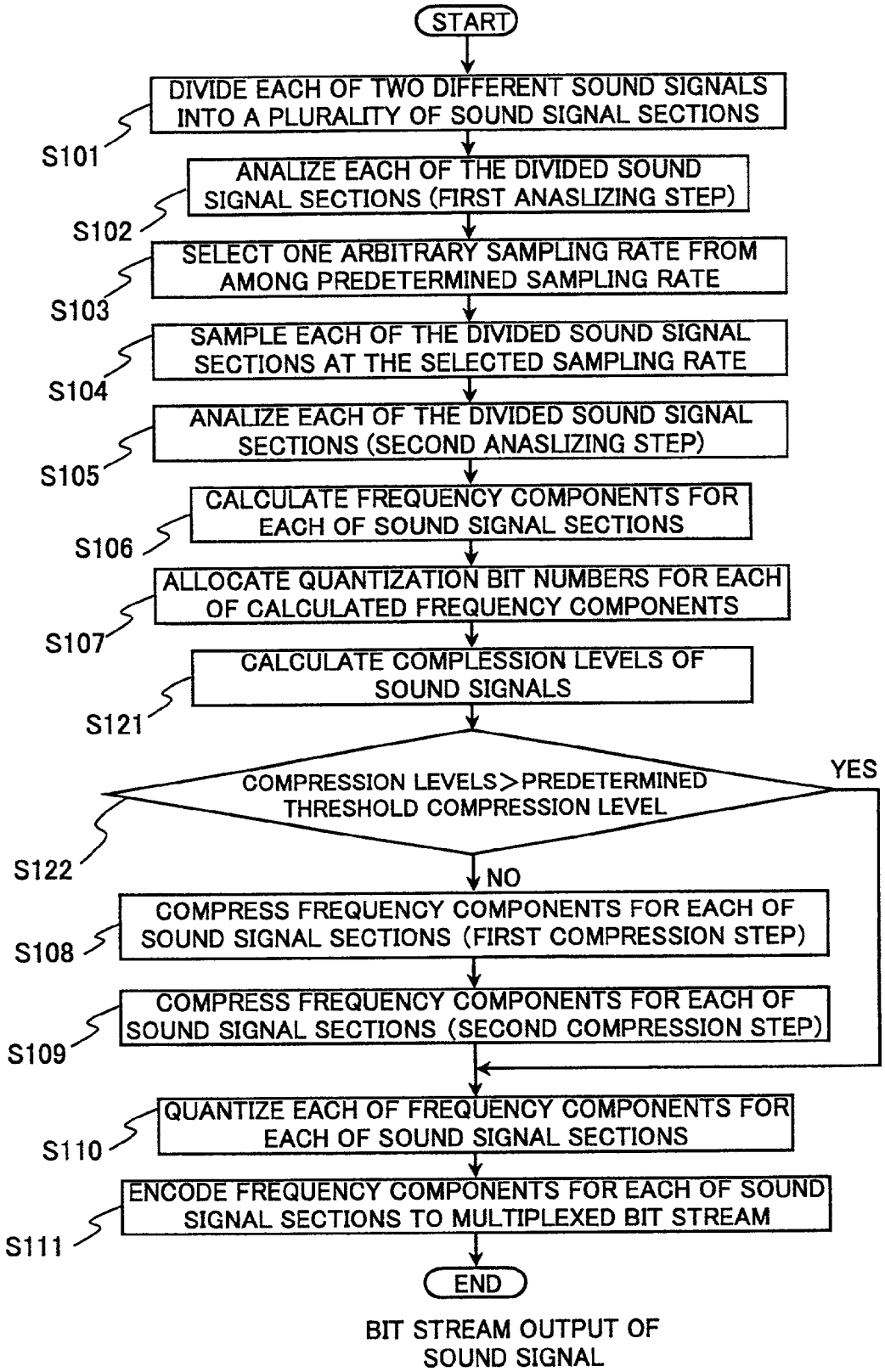
FIG. 7 is a flow chart of the exemplified process of the sound signal encoding apparatus shown in FIG. 1.
Figure 8:
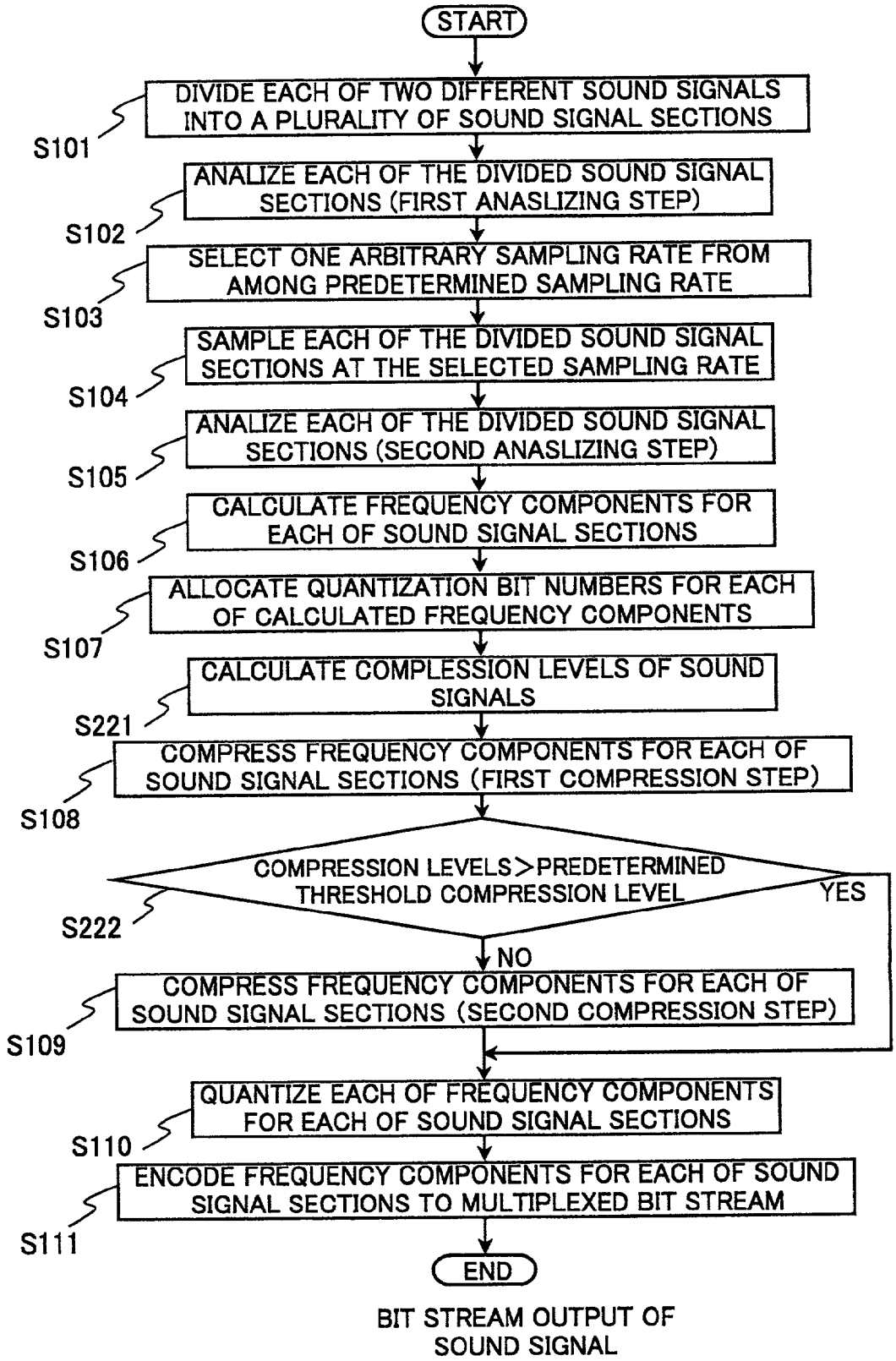
FIG. 8 is a flow chart of the exemplified process of the sound signal encoding apparatus shown in FIG. 2.

The following description will be directed to the operation of the first embodiment of the sound signal encoding apparatus 100 according to the present invention with reference to FIG. 7.

Each of the two different sound signals CH1 and CH2 is initially divided into a plurality of the sound signal sections along the time for each of the sound signals to be taken for receiving therein in sound signals dividing step S101. Each of the divided sound signal sections is then analyzed based on the sound signal characteristics inherent in the sound signal in first sound signal sections analyzing step S102. The one arbitrary sampling rate for each of the sound signal sections is then selected from among predetermined sampling rates based on each of the analyzed sound signal sections in sampling rate selecting step S103. Each of the sound signal sections is then sampled at the selected sampling rate in sound signal sampling step S104.

Each of the sound signal sections is then analyzed in second sound signal sections analyzing step S105 based on a psycho acoustic model obtained by taking advantage of human's hearing characteristics. Each of the frequency components for each of the sampled sound signal sections is then calculated in the frequency components calculating step S105 based on the Modified Discrete Cosine Transformation. The quantization bit numbers for each of the frequency components for each of the sound signal section is then allocated in the quantization bit numbers allocating step S107 based on the second sound signal sections analyzing step S105.

The compression level for each of the sound signal sections is then calculated in compression levels calculating step S121. The judgment is made whether or not the compression level for each of the sound signal sections exceeds a predetermined threshold compression level in compression level judging step S122. When the answer in compression level judging step S122 is in the affirmative "YES", i.e., the compression level for each of the sound signal sections exceeds a predetermined threshold compression value, the compression level judging step S122 goes to the first frequency components compressing step S108. When the answer in compression level judging step S122 is in the negative "NO", i.e., the compression level for each of the sound signal sections does not exceed a predetermined threshold compression value, the compression level judging step S122 goes to the second frequency components compressing step S109.

Each of the frequency components for each of the sound signal sections is then compressed with two different information consisting of a first and second signal based on the second sound signal sections analyzing means S105 in the first sound signal sections compressing step S108. The above first signal is indicative of the intensity signal jointed with each of the frequency components for each of the sound signal sections 1 to 3 and frequency components the sound signal sections 5 to 7. The above second signal is indicative of ratio of one of the frequency components for each of the sound signal sections 1 to 3 and frequency components the sound signal sections 5 to 7.

Each of the frequency components for each of the sound signal sections is then compressed with two different information consisting of a first and second signal based on the second sound signal sections analyzing means S105 in the first sound signal sections compressing step S109. The above first signal is indicative of the addition f11+f21 of each of the frequency components the first channel signal CH1 and each of the frequency components for the second channel signal CH2, while the above second signal being indicative of the difference f11–f21 between each of the frequency components for the first channel signal CH1 and each of the frequency components for the second channel signal CH2 based on the sound signal sections 1 to 3 and the sound signal sections 5 to 7.

Each of the frequency components for each of the sound signal sections is then quantized at the quantization bit numbers based on the second sound signal sections analyzing step S105 in the frequency components quantizing step S109 under two different states consisting of a first state in which the frequency components for each of the sound signal sections are compressed in the first frequency components compressing step S108 when the compression level judging step S122 is of judging that the compression level for each of the sound signal sections exceeds the predetermined threshold compression value and a second state in which the frequency components for each of the sound signal sections are not compressed in the first frequency components compressing step S108 when the compression level judging step S122 is of judging that the compression level for each of the sound signal sections does not exceed the predetermined threshold compression value.

The quantized frequency components for each of the sound signal sections is then encoded to a multiplexed bit stream in the frequency components encoding step S111 under two different states consisting of the first state in which the frequency components for each of the sound signal sections are compressed in the first frequency components compressing step S108 when the compression level judging step S122 is of judging that the compression level for each of the sound signal sections exceeds the predetermined threshold compression value and the second state in which the frequency components for each of the sound signal sections are compressed in the first frequency components compressing step S108 when the compression level judging step S122 is of judging that the compression level for each of the sound signal sections does not exceed the predetermined threshold compression value. The multiplexed bit stream is constituted by the sound signals for each of the sound signal sections and general information needed for the sound signals to be encoded and decoded.

The following description will now be directed to the calculation of the compression level of the first embodiment of the sound signal encoding apparatus 100 according to the present invention with reference to FIG. 7.

The compression level calculating step S121 is of calculating the compression level for each of the sound signal sections with the compression ratio of the selected sampling rate to the bit rate at which the multiplexed bit stream is outputted in the frequency components encoding step S111. The calculation of the compression level for each of the sound signal sections is performed by the following equation (1) for calculating the compression level for each of the sound signal sections with the compression ratio of the selected sampling rate to the bit rate.

$$\text{compression level}=\text{quantization bit numbers}\times\text{sampling rate}\times\text{channel number}/\text{multiplexed bit rate} \quad (1)$$

wherein the sampling rate is a value selected in the sampling rate selecting step S103, the multiplexed bit rate is a bit rate of the encoded sound signals outputted in the frequency components encoding step S111, the quantization bit numbers and the channel number are each a fixed value, for example, 16 bits, 2 channels respectively. The compression level for each of the sound signal sections CH1 and CH2 is calculated without the consideration of the channel numbers and the quantization bit numbers of the sound signals, as will be seen from the following equation.

$$\text{compression level}=\text{sampling rate}/\text{multiplexed bit rate} \quad (2)$$

When the ratio of the selected sampling rate to the multiplexed bit rate of the encoded sound signal outputted by the frequency components encoding step S111 is larger than the predetermined threshold compression value to allow the flag of the first sound signal sections compressing step S109 to be set, the flag of the first sound signal sections compressing step S109 is set to allow the first sound signal sections compressing S109 to start. When the ratio of the sampling rate to the multiplexed bit rate of the sound signals, on the other hand, is smaller than the predetermined compression value to inhibit the flag of the first sound signal sections compressing step S109 to be reset, the flag of the first sound signal sections compressing step S109 is set to inhibit the first sound signal sections compressing step S109 to start.

From the above detailed description, it will be understood that the sound signal can be encoded at a relatively high quality under two different states consisting of first and second states. In the above first state, the frequency components for each of the sound signal sections are compressed by the first frequency components compressing means 108 when the compression level judging means 122 is operative to judge that the compression level for each of the sound signal sections exceeds the predetermined threshold compression value. In the above second state, the frequency components for each of the sound signal sections are not compressed by the first frequency components compressing means 108 when the compression level judging means 122 is operative to judge that the compression level for each of the sound signal sections does not exceed the predetermined threshold compression value. The compression of the sound signal performed by the sound signal encoding apparatus thus constructed makes it possible to encode the sound signal at a relatively high quality with the inhibition of the first compression calculating process in the event that the compression rate of the sound signal is larger than the threshold compression value.

Although there has been described in the above about the first embodiment of the sound signal encoding apparatus according to the present invention, this embodiment may be replaced by the second to sixth embodiments of the sound signal encoding apparatus according to the present invention in order to attain the objects of the present invention. The second to sixth embodiments of the sound signal encoding apparatus will then be described hereinafter.

Referring then to FIGS. 2 to 6 of the drawings, there are shown block diagrams of the second to sixth preferred embodiments of the sound signal encoding apparatus according to the present invention. The constitution elements and the steps of the second to sixth embodiments of the sound signal encoding apparatus according to the present invention as shown in FIGS. 2 to 6 are entirely the same as those of the first embodiment of the sound signal encoding apparatus according to the present invention as shown in FIG. 1 except for the constitution elements and the steps appearing in the following description. Therefore, only the constitution elements and the steps of the second to sixth embodiments of the sound signal encoding apparatus different from those of the first embodiment of the sound signal encoding apparatus will be described in detail hereinafter. The constitution elements and the steps of the second to sixth embodiments of the sound signal encoding apparatus entirely the same as those of the first embodiment of the sound signal encoding apparatus will not be described but bear the same reference numerals and legends as those of the first embodiment of the sound signal encoding apparatus in FIG. 2 to avoid tedious repetition.

The following description will be directed to the constitution elements and the steps of the second embodiment of the sound signal encoding apparatus 200 different from those of the first embodiment of the sound signal encoding apparatus.

Figure 2:
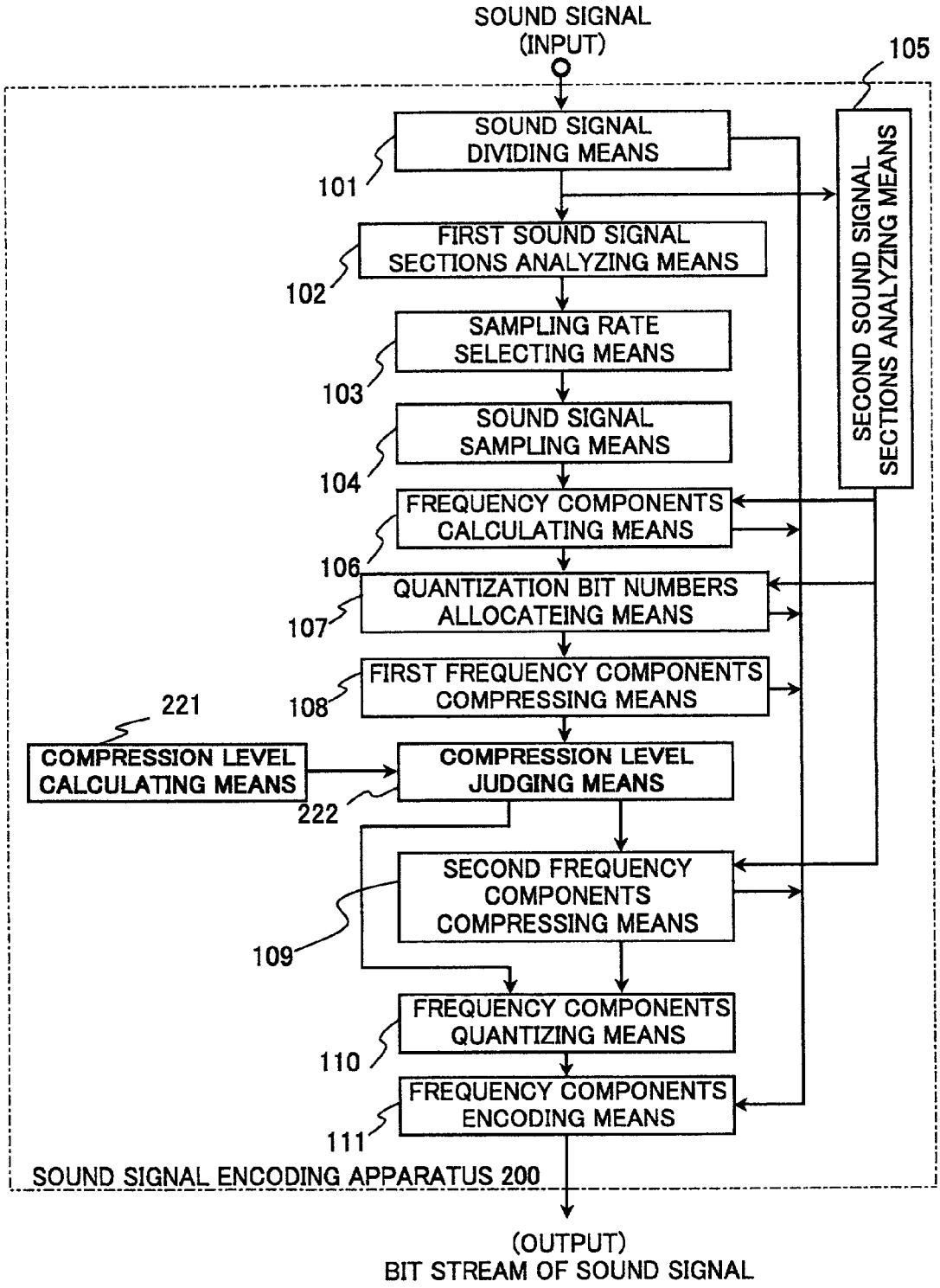
FIG. 2 is a block diagram of the second embodiment according to the present invention.

In addition to sound signals dividing means 101, first sound signal sections analyzing means 102, sampling rate selecting means 103, sampling rate selecting means 104, second sound signal sections analyzing means 105, frequency components calculating means 106, quantization bit numbers allocating means 107, first frequency components compressing means 108, and second frequency components compressing means 109, frequency components quantizing means 110, and frequency components encoding means 111, the second embodiment of the sound signal encoding apparatus according to the present invention is shown in FIG. 2 as further comprising compression level calculating means 221 and compression level judging means 222. The compression level calculating means 221 is operative to calculate the compression level for each of the sound signal sections. The compression level judging means 222 is operative to judge whether or not the compression level for each of the sound signal sections exceeds a predetermined threshold compression value. The compression level judging means 222 has a flag with two different states consisting of the first state in which the frequency components for each of the sound signal sections are compressed by the second frequency components compressing means 109 when the compression level judging means 222 is operative to judge that the compression level for each of the sound signal sections exceeds the predetermined threshold compression value and the second state in which the frequency components for each of the sound signal sections are not compressed by the second frequency components compressing means 109 when the energy ratio judging means 222 is operative to judge that the compression level for each of the sound signal sections does not exceed the predetermined threshold compression value.

The operation of the second embodiment of the sound signal encoding apparatus according to the present invention is carried out through a load condition judging process shown in FIG. 7 as comprising a compression level calculating step S221, and a compression level judging step S222. The compression level calculating step S221 is of calculating a compression level in accordance with the ratio of the selected sampling rate to the multiplexed bit rate. The compression level judging step S222 is of judging whether or not the frequency components for the sound signal section is compressed in the first frequency compressing step S107.

The compression level calculating step S221 is shown in FIG. 7 to calculate the compression level for each of the sound signal sections with the ratio of the selected sampling rate to the bit rate at which the multiplexed bit stream is outputted in the frequency components encoding step S111. The calculation of the compression level for each of the sound signal sections is performed by the following equation entirely same as the equation (1) for calculating the compression level for each of the sound signal sections with the ratio of the selected sampling rate to the bit rate as will be seen from the first embodiment of the sound signal encoding apparatus.

The compression level for each of the sound signal sections CH1 and CH2 is calculated without the consideration of the channel numbers and the quantization bit numbers of the sound signals by the equation (2) appearing for describing the first embodiment of the sound signal encoding apparatus.

When the ratio of the selected sampling rate to the multiplexed bit rate of the encoded sound signal outputted by the frequency components encoding step S111 is larger than the predetermined threshold compression value to allow the flag for the second frequency components compressing step S109 to be set, the flag for the second frequency components compressing step S109 is set to allow the second sound signal sections compressing S109 to start. When the ratio of the sampling rate to the multiplexed bit rate of the sound signals, on the other hand, is smaller than the predetermined compression value to inhibit the flag for the second sound signal sections compressing step S109 to be reset, the flag for the second sound signal sections compressing step S109 is set to inhibit the second sound signal sections compressing step S109 to start.

From the above detailed description, it will be understood that the sound signal can be encoded at a relatively high quality under two different states consisting of first and second states. In the first state, the frequency components for each of the sound signal sections are compressed by the second frequency components compressing means 109 when the compression level judging means 222 is operative to judge that the compression level for each of the sound signal sections exceeds the predetermined threshold compression value. In the second state, the frequency components for each of the sound signal sections are not compressed by the second frequency components compressing means 109 when the compression level judging means 222 is operative to judge that the compression level for each of the sound signal sections does not exceed the predetermined threshold compression value. The compression of the sound signal performed by the sound signal encoding apparatus thus constructed makes it possible to encode the sound signal at a relatively high quality.

The following description will now be directed to the constitution elements and the steps of the third embodiment of the sound signal encoding apparatus 300 different from those of the first and second embodiments of the sound signal encoding apparatus.

Figure 3:
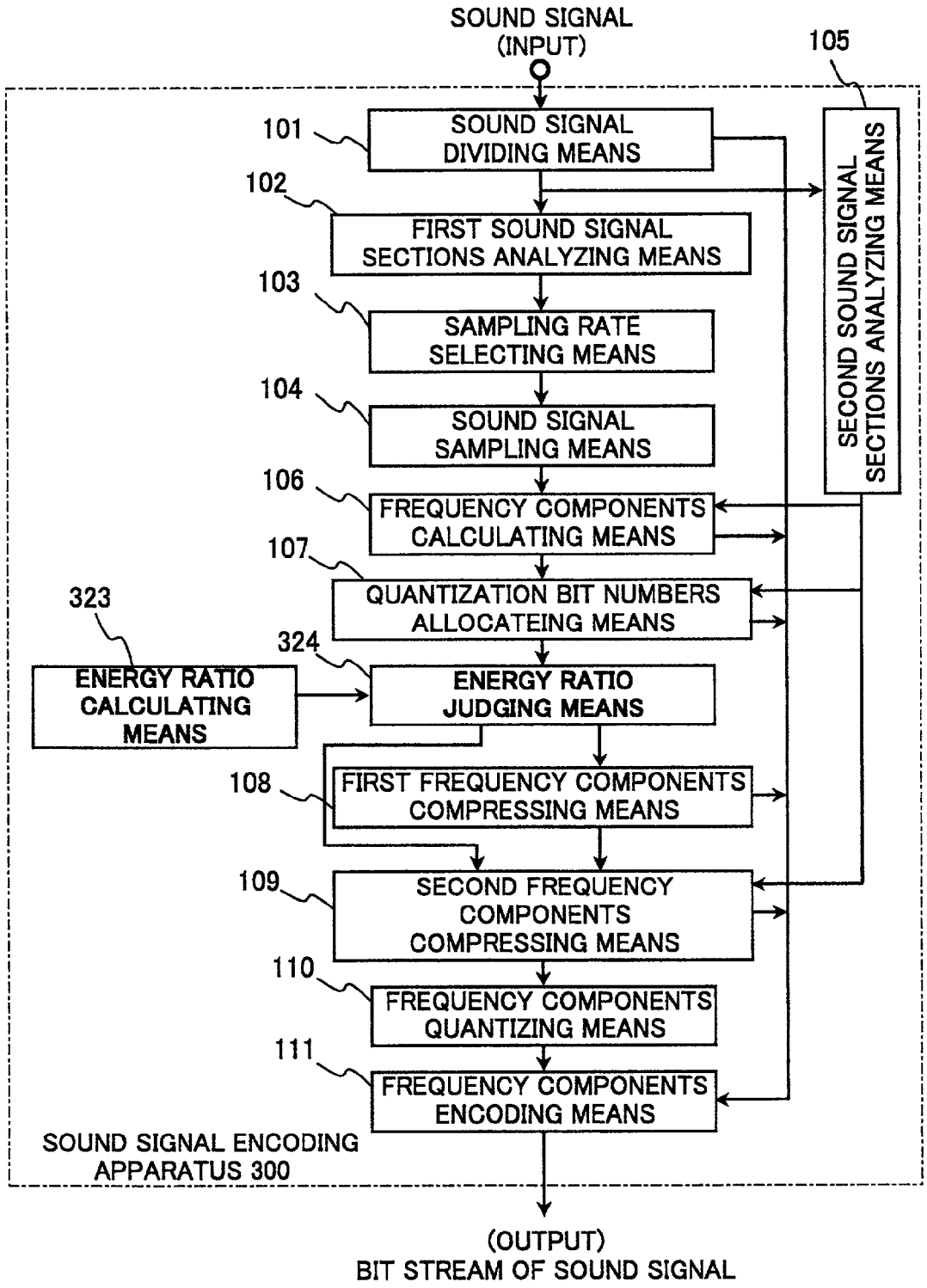
FIG. 3 is a block diagram of the third embodiment according to the present invention.

In addition to sound signals dividing means 101, first sound signal sections analyzing means 102, sampling rate selecting means 103, sampling rate selecting means 104, second sound signal sections analyzing means 105, frequency components calculating means 106, quantization bit numbers allocating means 107, first frequency components compressing means 108, and second frequency components compressing means 109, frequency components quantizing means 110, and frequency components encoding means 111, the third embodiment of the sound signal encoding apparatus according to the present invention is shown in FIG. 3 as further comprising energy ratio calculating means 323 and energy ratio judging means 324. The energy ratio calculating means 323 is operative to calculate five different information consisting of first to fifth signals; the above first signal is indicative of the addition of each of the frequency components for the first channel signal and each of the frequency components for the second channel signal; the above second signal being indicative of the difference between each of the frequency components for the first channel signal and each of the frequency components for the second channel signal; the above third signal is indicative of the energy level with the above first signal; the above fourth signal is indicative of the energy level with the above second signal; and the above fifth signal is indicative of the energy ratio of the above third signal to the above fourth signal. The energy ratio judging means 324 is operative to judge whether or not the energy ratio for each of the sound signal sections exceeds a predetermined threshold energy value. The energy ratio judging means 324 has a flag with two different states consisting of the first state in which the frequency components for each of the sound signal sections are compressed by the first frequency components compressing means 108 when the energy ratio judging means 324 is operative to judge that the energy ratio for each of the sound signal sections exceeds the predetermined threshold energy value and the second state in which the frequency components for each of the sound signal sections are not compressed by the first frequency components compressing means 108 when the energy ratio judging means 324 is operative to judge that the energy ratio for each of the sound signal sections does not exceed the predetermined threshold energy value.

Figure 9:
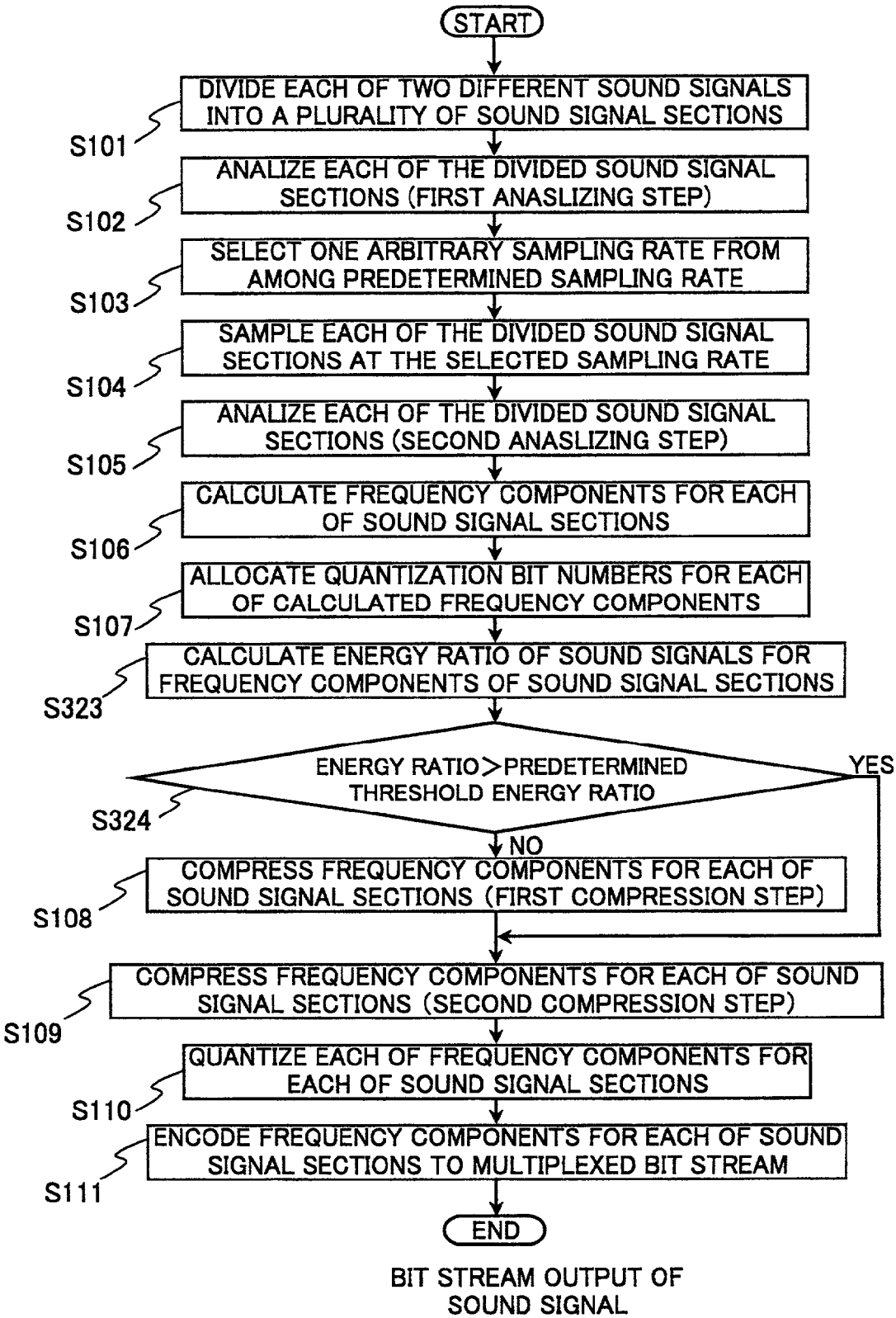
FIG. 9 is a flow chart of the exemplified process of the sound signal encoding apparatus shown in FIG. 3.

The operation of the third embodiment of the sound signal encoding apparatus according to the present invention is carried out through a load condition judging process shown in FIG. 9 as further comprising an energy ratio calculating step S323 and an energy ratio judging step S324. The energy ratio calculating step S323 is of calculating five different information consisting of first to fifth signals; the above first signal is indicative of the addition of each of the frequency components for the first channel signal and each of the frequency components for the second channel signal; the above second signal being indicative of the difference between each of the frequency components for the first channel signal and each of the frequency components for the second channel signal; the above third signal is indicative of the energy level with the above first signal; the above fourth signal is indicative of the energy level with the above second signal; and the above fifth signal is indicative of the energy ratio of the above third signal to the above fourth signal. The energy ratio judging step S324 is of judging whether or not the energy ratio for each of the sound signal sections exceeds a predetermined threshold energy value.

When the ratio of the selected sampling rate to the multiplexed bit rate of the encoded sound signal outputted by the frequency components encoding step S111 is larger than the predetermined threshold compression value to allow the flag for the first frequency components compressing step S108 to be set, the flag for the first frequency components compressing step S108 is set to allow the first sound signal sections compressing S108 to start. When the ratio of the sampling rate to the multiplexed bit rate of the sound signals, on the other hand, is smaller than the predetermined compression value to inhibit the flag for the first sound signal sections compressing step S108 to be reset, the flag for the first sound signal sections compressing step S108 is set to inhibit the first sound signal sections compressing step S108 to start.

From the above detailed description, it will be understood that the sound signal can be encoded at a relatively high quality under two different states consisting of first and second states. In the first state, the frequency components for each of the sound signal sections are compressed by the first frequency components compressing means 108 when the energy ratio judging means 324 is operative to judge that the energy ratio for each of the sound signal sections exceeds the predetermined threshold energy value. In the second state, the frequency components for each of the sound signal sections are not compressed by the first frequency components compressing means 108 when the energy ratio judging means 324 is operative to judge that the energy ratio for each of the sound signal sections does not exceed the predetermined threshold energy value. The compression of the sound signal performed by the sound signal encoding apparatus thus constructed makes it possible to encode the sound signal at a relatively high quality.

The following description will be directed to the constitution elements and the steps of the fourth embodiment of the sound signal encoding apparatus 400 different from those of the first to third embodiments of the sound signal encoding apparatus.

Figure 4:
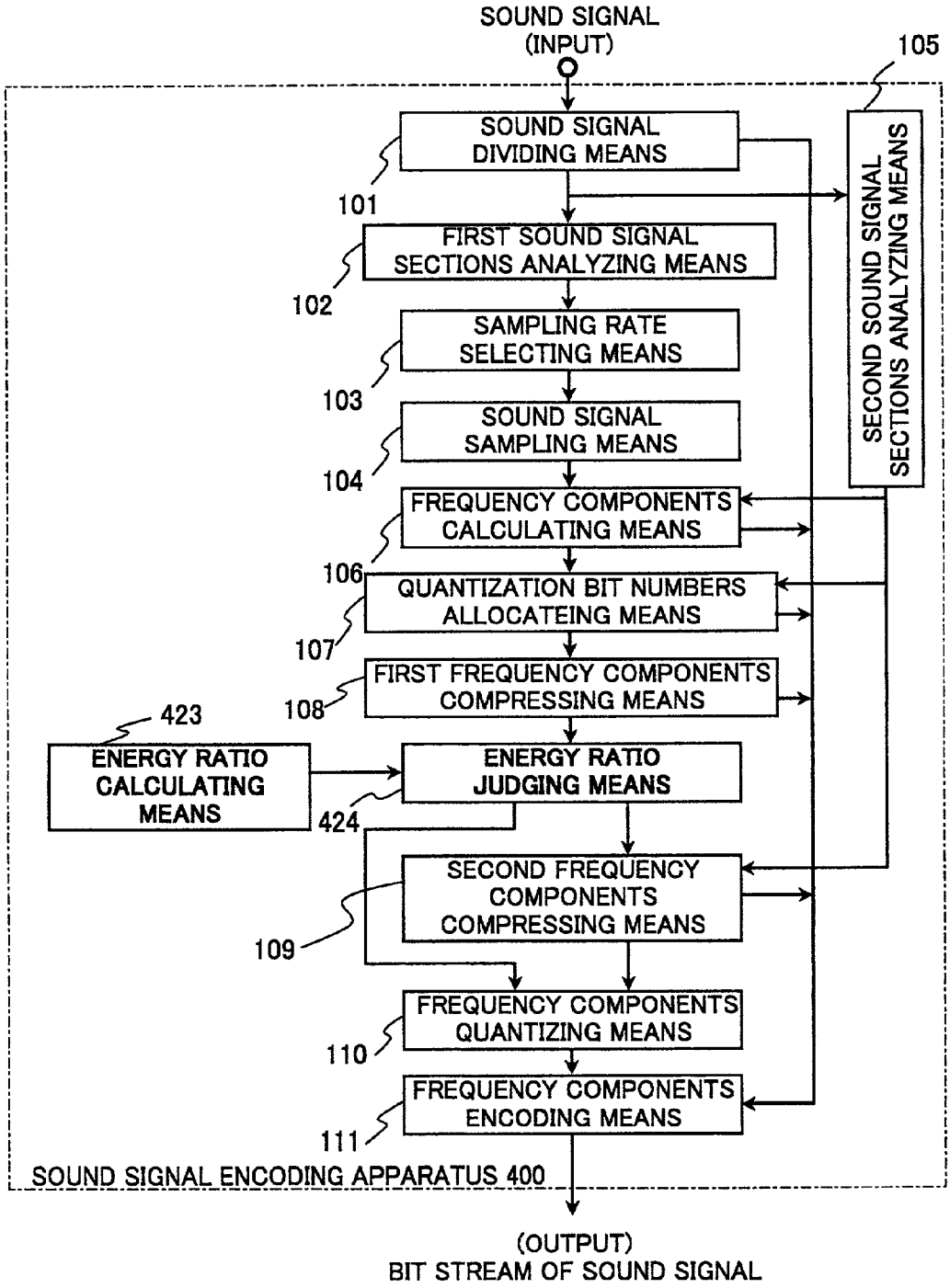
FIG. 4 is a block diagram of the fourth embodiment according to the present invention.

In addition to sound signals dividing means 101, first sound signal sections analyzing means 102, sampling rate selecting means 103, sampling rate selecting means 104, second sound signal sections analyzing means 105, frequency components calculating means 106, quantization bit numbers allocating means 107, first frequency components compressing means 108, and second frequency components compressing means 109, frequency components quantizing means 110, and frequency components encoding means 111, the fourth embodiment of the sound signal encoding apparatus according to the present invention is shown in FIG. 4 as further comprising energy ratio calculating means 423 and energy ratio judging means 424. The energy ratio calculating means 423 is operative to calculate five different information consisting of first to fifth signals; the above first signal is indicative of the addition of each of the frequency components for the first channel signal and each of the frequency components for the second channel signal; the above second signal being indicative of the difference between each of the frequency components for the first channel signal and each of the frequency components for the second channel signal; the above third signal is indicative of the energy level with the above first signal; the above fourth signal is indicative of the energy level with the above second signal; and the above fifth signal is indicative of the energy ratio of the above third signal to the above fourth signal. The energy ratio judging means 424 is operative to judge whether or not the energy ratio for each of the sound signal sections exceeds a predetermined threshold energy value. The energy ratio judging means 424 has a flag with two different states consisting of the first state in which the frequency components for each of the sound signal sections are compressed by the second frequency components compressing means 109 when the energy ratio judging means 424 is operative to judge that the energy ratio for each of the sound signal sections exceeds the predetermined threshold energy value and the second state in which the frequency components for each of the sound signal sections are not compressed by the second frequency components compressing means 109 when the energy ratio judging means 424 is operative to judge that the energy ratio for each of the sound signal sections does not exceed the predetermined threshold energy value.

Figure 10:
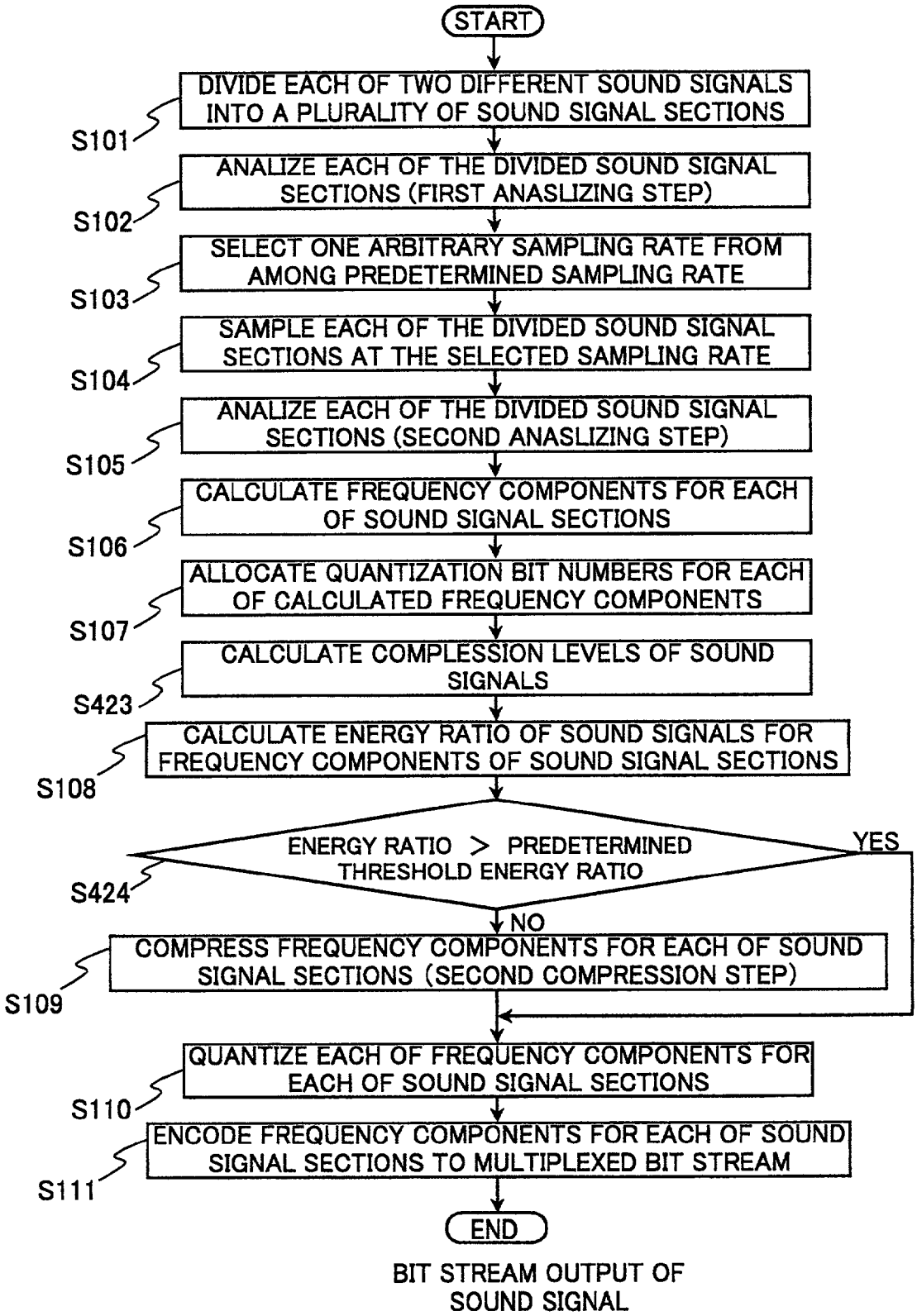
FIG. 10 is a flow chart of the exemplified process of the sound signal encoding apparatus shown in FIG. 4.

The operation of the third embodiment of the sound signal encoding apparatus according to the present invention is carried out through a load condition judging process shown in FIG. 10 as comprising an energy ratio calculating step S423 and an energy ratio judging step S424. The energy ratio calculating step S423 is of calculating five different information consisting of first to fifth signals. The above first signal is indicative of the addition of each of the frequency components for the first channel signal and each of the frequency components for the second channel signal. The above second signal is indicative of the difference between each of the frequency components for the first channel signal and each of the frequency components for the second channel signal. The above third signal is indicative of the energy level with the above first signal. The above fourth signal is indicative of the energy level with the above second signal. The above fifth signal is indicative of the energy ratio of the above third signal to the above fourth signal. The energy ratio judging step S424 is of judging whether or not the energy ratio for each of the sound signal sections exceeds a predetermined threshold energy value.

When the ratio of the selected sampling rate to the multiplexed bit rate of the encoded sound signal outputted by the frequency components encoding step S111 is larger than the predetermined threshold compression value to allow the flag for the second frequency components compressing step S109 to be set, the flag for the second frequency components compressing step S109 is set to allow the second sound signal sections compressing S109 to start. When the ratio of the sampling rate to the multiplexed bit rate of the sound signals, on the other hand, is smaller than the predetermined compression value to inhibit the flag for the second sound signal sections compressing step S109 to be reset, the flag for the second sound signal sections compressing step S109 is set to inhibit the second sound signal sections compressing step S109 to start.

From the above detailed description, it will be understood that the sound signal can be encoded at a relatively high quality under two different states consisting of first and second states. In the first state, the frequency components for each of the sound signal sections are compressed by the second frequency components compressing means 109 when the energy ratio judging means 424 is operative to judge that the energy ratio for each of the sound signal sections exceeds the predetermined threshold energy value. In the second state, the frequency components for each of the sound signal sections are not compressed by the second frequency components compressing means 109 when the energy ratio judging means 424 is operative to judge that the energy ratio for each of the sound signal sections does not exceed the predetermined threshold energy value. The compression of the sound signal performed by the sound signal encoding apparatus thus constructed makes it possible to encode the sound signal at a relatively high quality.

The following description will be directed to the constitution elements and the steps of the fifth embodiment of the sound signal encoding apparatus 500 different from those of the first to fourth embodiments of the sound signal encoding apparatus.

Figure 5:
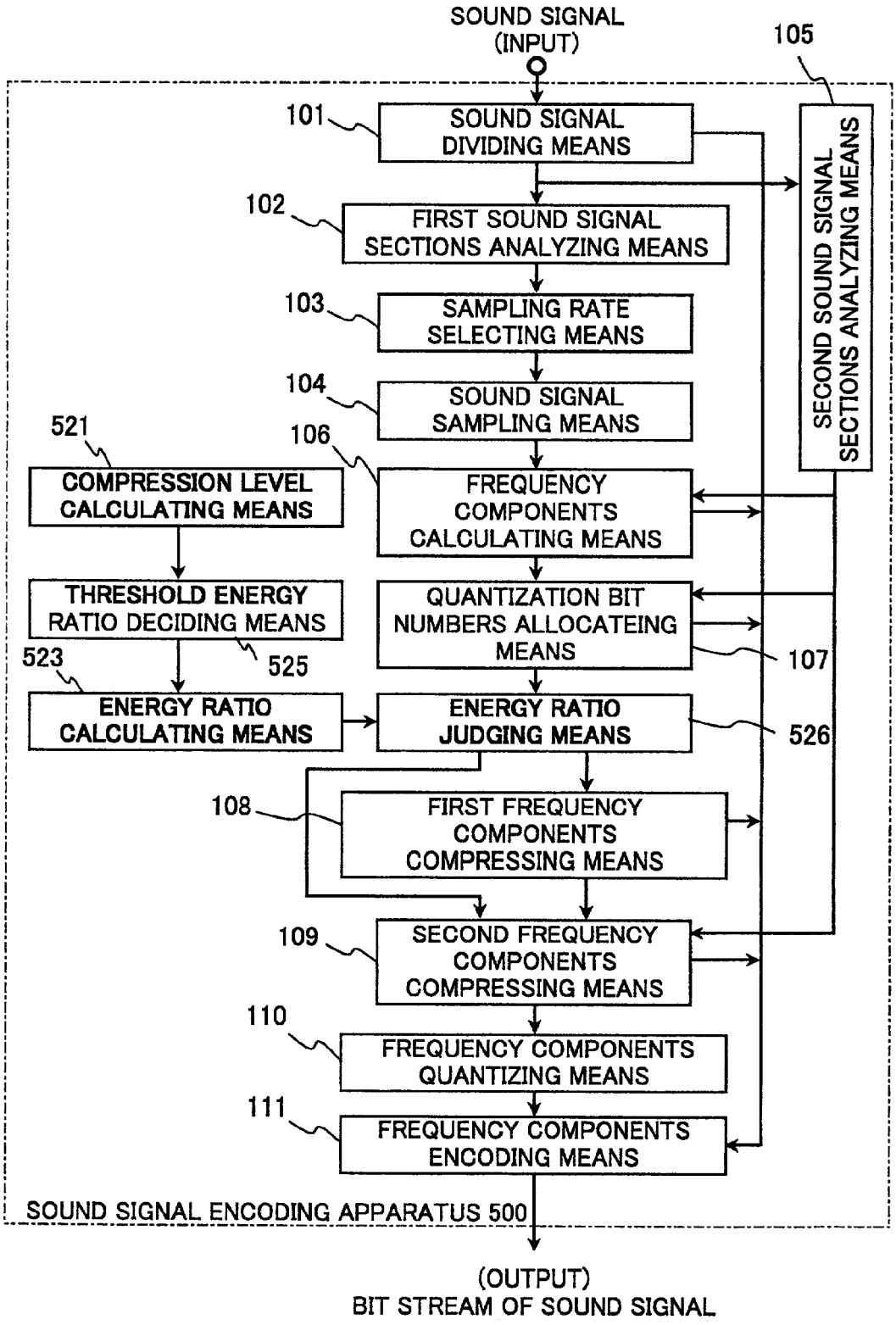
FIG. 5 is a block diagram of the fifth embodiment according to the present invention.

In addition to sound signals dividing means 101, first sound signal sections analyzing means 102, sampling rate selecting means 103, sampling rate selecting means 104, second sound signal sections analyzing means 105, frequency components calculating means 106, quantization bit numbers allocating means 107, first frequency components compressing means 108, and second frequency components compressing means 109, frequency components quantizing means 110, and frequency components encoding means 111, the fifth embodiment of the sound signal encoding apparatus according to the present invention is shown in FIG. 5 as further comprising compression level calculating means 521, threshold energy value selecting means 525, energy ratio calculating means 523 and energy ratio judging means 526. The compression level calculating means 521 is operative to calculate a compression level for each of said sound signal sections. The threshold energy value selecting means 525 is operative to select one arbitrary threshold energy value for each of said sound signal sections from among predetermined threshold energy values based on said compression level calculated by said compression level calculating means 521.

The energy ratio calculating means 523 is operative to calculate five different information consisting of first to fifth signals. The above first signal is indicative of the addition of each of the frequency components for the first channel signal and each of the frequency components for the second channel signal The above second signal is indicative of the difference between each of the frequency components for the first channel signal and each of the frequency components for the second channel signal. The above third signal is indicative of the energy level with the above first signal; the above fourth signal is indicative of the energy level with the above second signal. The above fifth signal is indicative of the energy ratio of the above third signal to the above fourth signal. The energy ratio judging means 526 is operative to judge whether or not the energy ratio for each of the sound signal sections exceeds a predetermined threshold energy value. The energy ratio judging means 526 has a flag with two different states consisting of the first state in which the frequency components for each of the sound signal sections are compressed by the first frequency components compressing means 108 when the energy ratio judging means 526 is operative to judge that the energy ratio for each of the sound signal sections exceeds the predetermined threshold energy value and the second state in which the frequency components for each of the sound signal sections are not compressed by the first frequency components compressing means 109 when the energy ratio judging means 526 is operative to judge that the energy ratio for each of the sound signal sections does not exceed the predetermined threshold energy value.

The energy ratio judging means 526 has a flag with two different states consisting of the first state in which the frequency components for each of the sound signal sections are compressed by the first frequency components compressing means 108 when the energy ratio judging means 526 is operative to judge that the energy ratio for each of the sound signal sections exceeds the predetermined threshold energy value and the second state in which the frequency components for each of the sound signal sections are not compressed by the first frequency components compressing means 109 when the energy ratio judging means 526 is operative to judge that the energy ratio for each of the sound signal sections does not exceed the predetermined threshold energy value.

Figure 11:
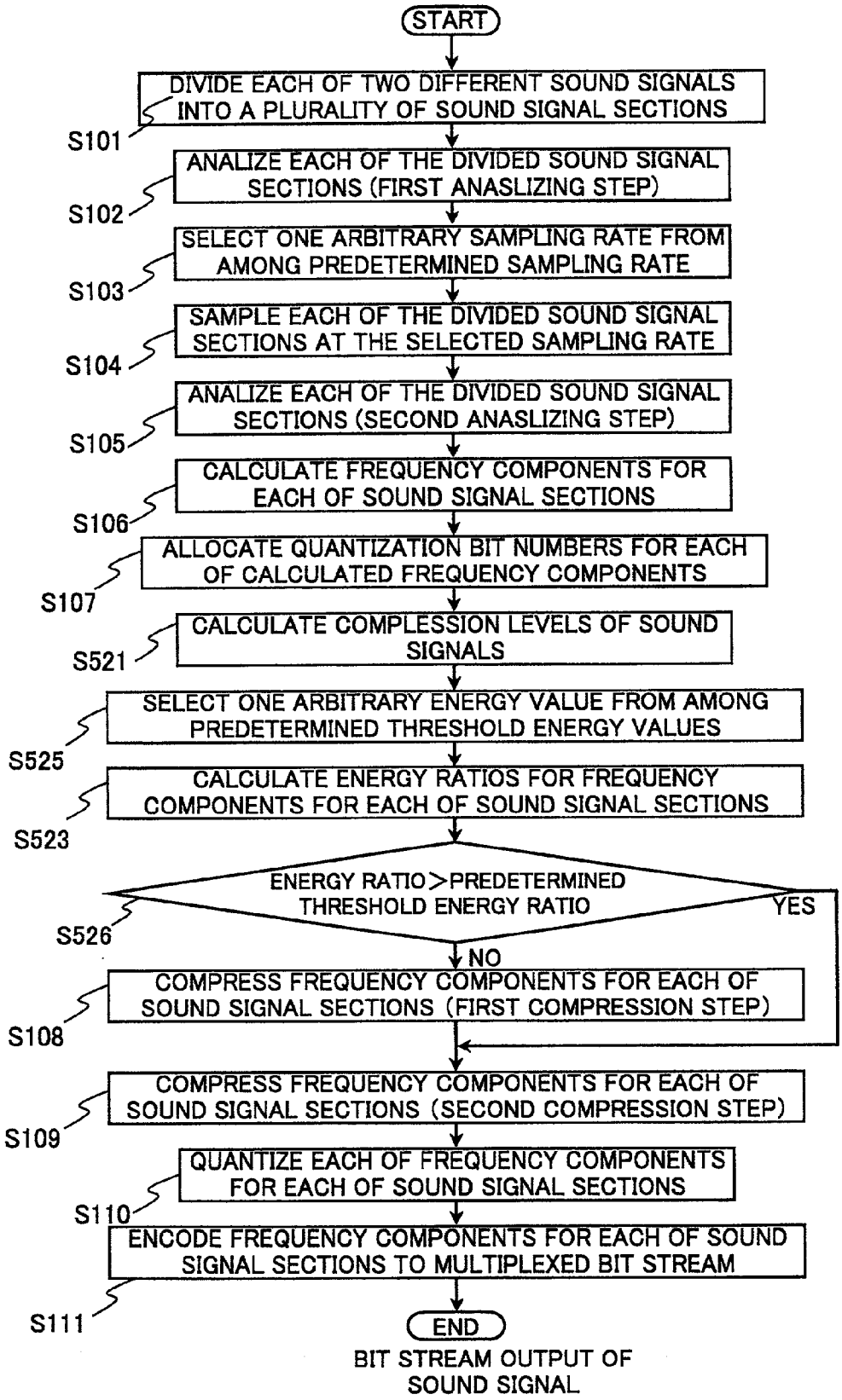
FIG. 11 is a flow chart of the exemplified process of the sound signal encoding apparatus shown in FIG. 5.

The operation of the fifth embodiment of the sound signal encoding apparatus according to the present invention is carried out through a load condition judging process shown in FIG. 11 as further comprising a compression level calculating step S521, a threshold energy value selecting step S525, an energy ratio calculating step S523 and an energy ratio judging step S526. The compression level calculating step S521 is of calculating a compression level for each of said sound signal sections.

The compression level calculating step S521 is shown in FIG. 11 to calculate the compression level for each of the sound signal sections with the compression ratio of the selected sampling rate to the bit rate at which the multiplexed bit stream is outputted in the frequency components encoding step S111. The calculation of the compression level for each of the sound signal sections is performed by the following equation entirely same as the equation (1) for calculating the compression level for each of the sound signal sections with the compression ratio of the selected sampling rate to the bit rate as will be seen from the first embodiment of the sound signal encoding apparatus.

The compression level for each of the sound signal sections CH1 and CH2 is calculated without the consideration of the channel numbers and the quantization bit numbers of the sound signals by the equation (2) appearing for describing the first embodiment of the sound signal encoding apparatus.

The threshold energy value selecting step S525 is of selecting one arbitrary threshold energy value for each of said sound signal sections from among predetermined threshold energy values based on said compression level calculated in said compression level calculating step S521. The energy ratio calculating step S523 is of calculating five different information consisting of first to fifth signals. The above first signal is indicative of the addition of each of the frequency components for the first channel signal and each of the frequency components for the second channel signal. The above second signal is indicative of the difference between each of the frequency components for the first channel signal and each of the frequency components for the second channel signal. The above third signal is indicative of the energy level with the above first signal. The above fourth signal is indicative of the energy level with the above second signal. The above fifth signal is indicative of the energy ratio of the above third signal to the above fourth signal. The energy ratio judging step S526 is of judging whether or not the energy ratio for each of the sound signal sections exceeds a predetermined threshold energy value.

When the ratio of the selected sampling rate to the multiplexed bit rate of the encoded sound signal outputted by the frequency components encoding step S111 is larger than the predetermined threshold compression value to allow the flag for the first frequency components compressing step S108 to be set, the flag for the first frequency components compressing step S108 is set to allow the first sound signal sections compressing S108 to start. When the ratio of the sampling rate to the multiplexed bit rate of the sound signals, on the other hand, is smaller than the predetermined compression value to inhibit the flag for the first sound signal sections compressing step S108 to be reset, the flag for the first sound signal sections compressing step S108 is set to inhibit the first sound signal sections compressing step S108 to start.

From the above detailed description, it will be understood that the sound signal can be encoded at a relatively high quality under two different states consisting of first and second states. In the first state, the frequency components for each of the sound signal sections are compressed by the first frequency components compressing means 108 when the energy ratio judging means 124*a* is operative to judge that the energy ratio for each of the sound signal sections exceeds the predetermined threshold energy value. In the second state, the frequency components for each of the sound signal sections are not compressed by the first frequency components compressing means 108 when the energy ratio judging means 124*a* is operative to judge that the energy ratio for each of the sound signal sections does not exceed the predetermined threshold energy value. The compression of the sound signal performed by the sound signal encoding apparatus thus constructed makes it possible to encode the sound signal at a relatively high quality.

The following description will be directed to the constitution elements and the steps of the sixth embodiment of the sound signal encoding apparatus 600 different from those of the first to fifth embodiments of the sound signal encoding apparatus.

Figure 6:
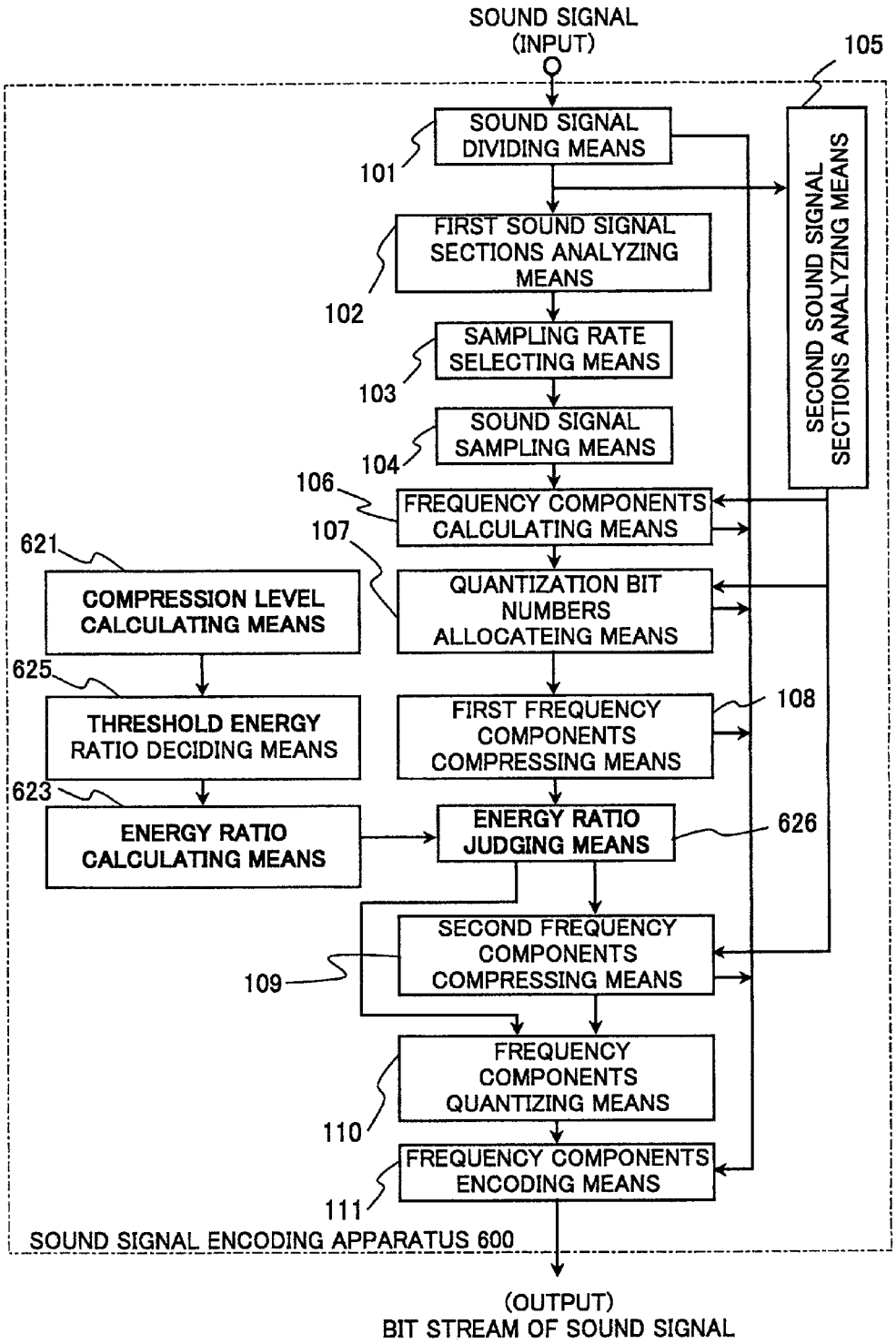
FIG. 6 is a block diagram of the sixth embodiment according to the present invention.

In addition to sound signals dividing means 101, first sound signal sections analyzing means 102, sampling rate selecting means 103, sampling rate selecting means 104, second sound signal sections analyzing means 105, frequency components calculating means 106, quantization bit numbers allocating means 107, first frequency components compressing means 108, and second frequency components compressing means 109, frequency components quantizing means 110, and frequency components encoding means 111, the sixth embodiment of the sound signal encoding apparatus according to the present invention is shown in FIG. 6 as further comprising compression level calculating means 621, threshold energy value selecting means 625, energy ratio calculating means 623 and energy ratio judging means 626. The compression level calculating means 521 is operative to calculate a compression level for each of said sound signal sections. The threshold energy value selecting means 525 is operative to select one arbitrary threshold energy value for each of said sound signal sections from among predetermined threshold energy values based on said compression level calculated by said compression level calculating means 521.

The energy ratio calculating means 623 is operative to calculate five different information consisting of first to fifth signals. The above first signal is indicative of the addition of each of the frequency components for the first channel signal and each of the frequency components for the second channel signal. The above second signal is indicative of the difference between each of the frequency components for the first channel signal and each of the frequency components for the second channel signal. The above third signal is indicative of the energy level with the above first signal. The above fourth signal is indicative of the energy level with the above second signal. The above fifth signal is indicative of the energy ratio of the above third signal to the above fourth signal. The energy ratio judging means 626 is operative to judge whether or not the energy ratio for each of the sound signal sections exceeds a predetermined threshold energy value.

The energy ratio judging means 626 has a flag with two different states consisting of the first state in which the frequency components for each of the sound signal sections are compressed by the second frequency components compressing means 109 when the energy ratio judging means 626 is operative to judge that the energy ratio for each of the sound signal sections exceeds the predetermined threshold energy value and the second state in which the frequency components for each of the sound signal sections are not compressed by the second frequency components compressing means 108 when the energy ratio judging means 626 is operative to judge that the energy ratio for each of the sound signal sections does not exceed the predetermined threshold energy value.

Figure 12:
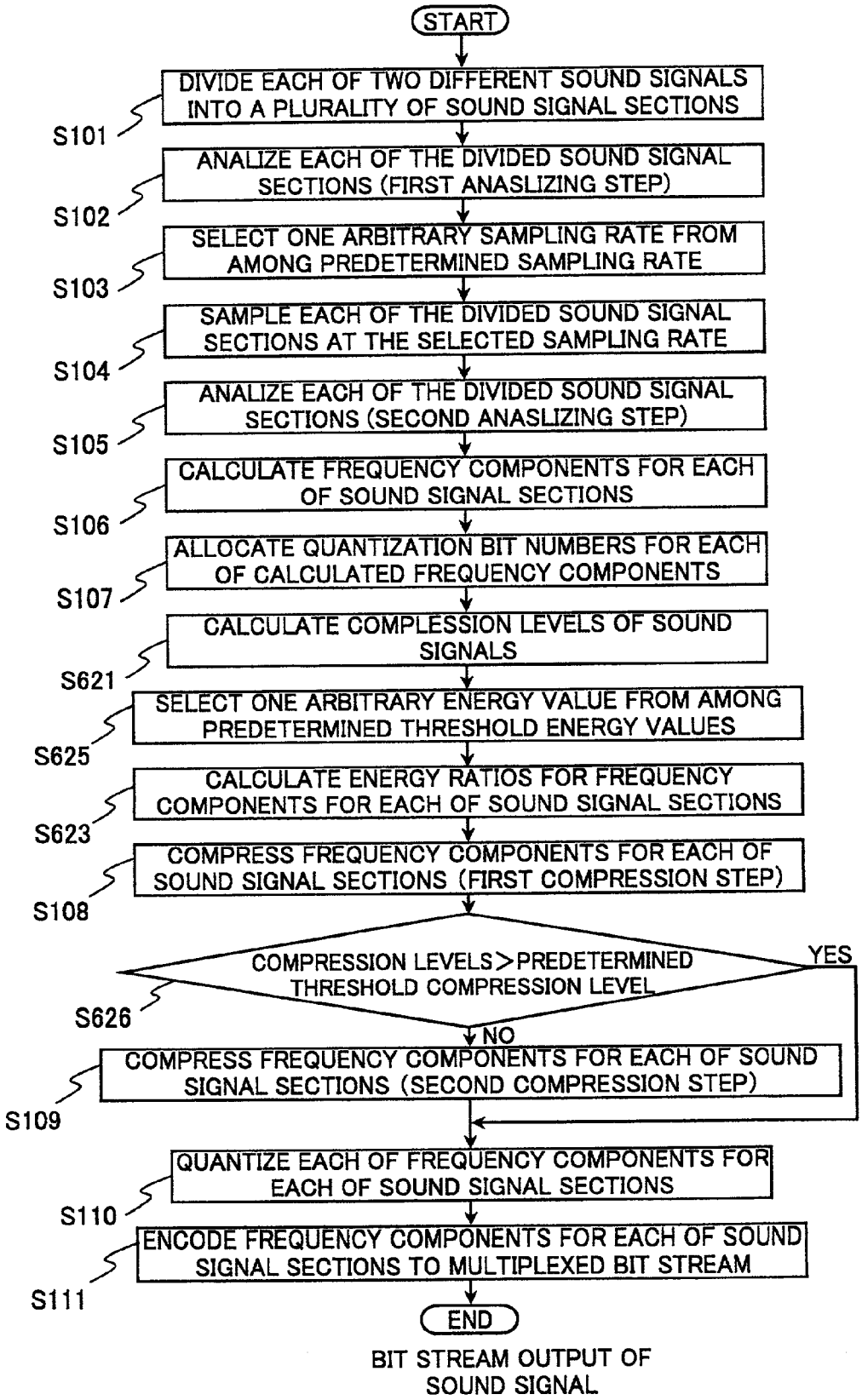
FIG. 12 is a flow chart of the exemplified process of the sound signal encoding apparatus shown in FIG. 6.

The compression level calculating step S621 is shown in FIG. 12 to calculate the compression level for each of the sound signal sections with the compression ratio of the selected sampling rate to the bit rate at which the multiplexed bit stream is outputted in the frequency components encoding step S111. The calculation of the compression level for each of the sound signal sections is performed by the following equation entirely same as the equation (1) for calculating the compression level for each of the sound signal sections with the compression ratio of the selected sampling rate to the bit rate as will be seen from the first embodiment of the sound signal encoding apparatus.

The compression level for each of the sound signal sections CH1 and CH2 is calculated without the consideration of the channel numbers and the quantization bit numbers of the sound signals by the equation (2) appearing for describing the first embodiment of the sound signal encoding apparatus.

The operation of the sixth embodiment of the sound signal encoding apparatus according to the present invention is carried out through a load condition judging process shown in FIG. 6 as further comprising a compression level calculating step S621, a threshold energy value selecting step S625, an energy ratio calculating step S623, and an energy ratio judging step S626. The compression level calculating step S621 is of calculating a compression level for each of said sound signal sections. The compression level calculating step S621 is shown in FIG. 12 to calculate the compression level for each of the sound signal sections with the compression ratio of the selected sampling rate to the bit rate at which the multiplexed bit stream is outputted in the frequency components encoding step S111. The calculation of the compression level for each of the sound signal sections is performed by the following equation entirely same as the equation (1) for calculating the compression level for each of the sound signal sections with the compression ratio of the selected sampling rate to the bit rate as will be seen from the first embodiment of the sound signal encoding apparatus.

The compression level for each of the sound signal sections CH1 and CH2 is calculated without the consideration of the channel numbers and the quantization bit numbers of the sound signals by the equation (2) appearing for describing the first embodiment of the sound signal encoding apparatus.

The threshold energy value selecting step S625 is of selecting one arbitrary threshold energy value for each of said sound signal sections from among predetermined threshold energy values based on said compression level calculated in said compression level calculating step S621. The energy ratio calculating step S623 is of calculating five different information consisting of first to fifth signals. The above first signal is indicative of the addition of each of the frequency components for the first channel signal and each of the frequency components for the second channel signal. The above second signal is indicative of the difference between each of the frequency components for the first channel signal and each of the frequency components for the second channel signal. The above third signal is indicative of the energy level with the above first signal. The above fourth signal is indicative of the energy level with the above second signal. The above fifth signal is indicative of the energy ratio of the above third signal to the above fourth signal. The energy ratio judging step S626 is of judging whether or not the energy ratio for each of the sound signal sections exceeds a predetermined threshold energy value.

When the ratio of the selected sampling rate to the multiplexed bit rate of the encoded sound signal outputted by the frequency components encoding step S111 is larger than the predetermined threshold compression value to allow the flag for the second frequency components compressing step S109 to be set, the flag for the second frequency components compressing step S109 is set to allow the second sound signal sections compressing S109 to start. When the ratio of the sampling rate to the multiplexed bit rate of the sound signals, on the other hand, is smaller than the predetermined compression value to inhibit the flag for the second sound signal sections compressing step S109 to be reset, the flag for the second sound signal sections compressing step S109 is set to inhibit the second sound signal sections compressing step S109 to start.

From the above detailed description, it will be understood that the sound signal can be encoded at a relatively high quality under two different states consisting of first and second states. In the first state, the frequency components for each of the sound signal sections are compressed by the second frequency components compressing means 109 when the energy ratio judging means 624 is operative to judge that the energy ratio for each of the sound signal sections exceeds the predetermined threshold energy value. In the second state, the frequency components for each of the sound signal sections are not compressed by the second frequency components compressing means 109 when the energy ratio judging means **124*b*** is operative to judge that the energy ratio for each of the sound signal sections does not exceed the predetermined threshold energy value. The compression of the sound signal performed by the sound signal encoding apparatus thus constructed makes it possible to encode the sound signal at a relatively high quality.

While the subject invention has been described with relation to the preferred embodiments, various modifications and adaptations thereof will now be apparent to those skilled in the art as far as such modifications and adaptations fall within the scope of the appended claims intended to be covered thereby.

What is claimed is:

1. A sound signal encoding apparatus for encoding two different sound signals, comprising:

sound signals dividing means for dividing each of said two different sound signals into a plurality of sound signal sections along a time axis for each of said sound signals to be taken for receiving therein, said sound signals consisting of a first channel signal and a second channel signal;

first sound signal sections analyzing means for analyzing each of said divided sound signal sections based on the sound signal characteristics inherent in said sound signal;

sampling rate selecting means for selecting one arbitrary sampling rate for each of said analyzed sound signal sections from among predetermined sampling rates;

sound signal sampling means for sampling each of said analyzed sound signal sections at said sampling rate selected by said sampling rate selecting means;

second sound signal sections analyzing means for analyzing each of said divided sound signal sections based on a psycho acoustic model obtained by taking advantage of human's hearing characteristics;

frequency components calculating means for calculating frequency components with two different information consisting of first and second signals for each of said sound signal sections sampled at said selected sampling rate, said above first signal being indicative of intensities, and said above second signal being indicative of frequencies;

quantization bit numbers allocating means for allocating quantization bit numbers for each of said calculated frequency components for each of said sound signal sections;

compression level calculating means for calculating a compression level for each of said sound signal sections;

compression level judging means for judging whether or not said calculated compression level for each of said sound signal sections exceeds a predetermined threshold compression value;

first frequency components compressing means for compressing said frequency components for each of said sound signal sections with two different information consisting of first and second signals, said above first signal being indicative of said intensities and said above second signal being indicative of ratio of one of said frequency components for said first channel signal and said frequency components for said second channel signal to the other of said frequency components for said first channel signal and said frequency components for said second channel signal;

second frequency components compressing means for compressing said frequency components for each of said sound signal sections with two different information consisting of first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

frequency components quantizing means for quantizing each of said frequency components for each of said sound signal sections at predetermined quantization bit numbers under two different states consisting of a first state in which said frequency components for each of said sound signal sections are compressed by said first frequency components compressing means when said compression level judging means is operative to judge that said compression level for each of said sound signal sections exceeds said predetermined threshold compression value and a second state in which said frequency components for each of said sound signal sections are not compressed by said first frequency components compressing means when said compression level judging means is operative to judge that said compression level for each of said sound signal sections does not exceed said predetermined threshold compression value; and frequency components encoding means for encoding said quantized frequency components for each of said sound signal sections to a multiplexed bit stream with a predetermined bit rate under two different states consisting of said first state in which said frequency components for each of said sound signal sections are compressed by said first frequency components compressing means when said compression level judging means is operative to judge that said compression level for each of said sound signal sections exceeds said predetermined threshold compression value and said second state in which said frequency components for each of said sound signal sections are not compressed by said first frequency components compressing means when said compression level judging means is operative to judge that said compression level for each of said sound signal sections does not exceed said predetermined threshold compression value, said multiplexed bit stream with said predetermined bit rate being constituted by said sound signals for each of said sound signal sections and general information needed for said sound signals to be encoded and decoded.

2. A sound signal encoding apparatus for encoding two different sound signals, comprising:

sound signals dividing means for dividing each of said two different sound signals into a plurality of sound signal sections along a time axis for each of said sound signals to be taken for receiving therein, said sound signals consisting of a first channel signal and a second channel signal;

first sound signal sections analyzing means for analyzing each of said divided sound signal sections based on the sound signal characteristics inherent in said sound signal;

sampling rate selecting means for selecting one arbitrary sampling rate for each of said analyzed sound signal sections from among predetermined sampling rates;

sound signal sampling means for sampling each of said divided sound signal sections at said sampling rate selected by said sampling rate selecting means;

second sound signal sections analyzing means for analyzing each of said divided sound signal sections based on a psycho acoustic model obtained by taking advantage of human's hearing characteristics;

frequency components calculating means for calculating frequency components with two different information consisting of first and second signals for each of said sound signal sections sampled at said selected sampling rate, said above first signal being indicative of intensities, and said above second signal being indicative of frequencies;

quantization bit numbers allocating means for allocating quantization bit numbers for each of said calculated frequency components for each of said sound signal sections;

compression level calculating means for calculating a compression level for each of said sound signal sections;

compression level judging means for judging whether or not said compression level for each of said sound signal sections exceeds a predetermined threshold compression value;

first frequency components compressing means for compressing said frequency components for each of said sound signal sections with two different information consisting of first and second signals, said above first signal being indicative of said intensities and said above second signal being indicative of ratio of one of said frequency components for said first channel signal and said frequency components for said second channel signal to the other of said frequency components for said first channel signal and said frequency components for said second channel signal;

second frequency components compressing means for compressing said frequency components for each of said sound signal sections with two different information consisting of first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

frequency components quantizing means for quantizing each of said frequency components for each of said sound signal sections at predetermined quantization bit numbers under two different states consisting of a first state in which said frequency components for each of said sound signal sections are compressed by said second frequency components compressing means when said compression level judging means is operative to judge that said compression level for each of said sound signal sections exceeds said predetermined threshold compression value and a second state in which said frequency components for each of said sound signal sections are not compressed by said second frequency components compressing means when said compression level judging means is operative to judge that said compression level for each of said sound signal sections does not exceed said predetermined threshold compression value; and frequency components encoding means for encoding said quantized frequency components for each of said sound signal sections to a multiplexed bit stream with a predetermined bit rate under two different states consisting of said first state in which said frequency components for each of said sound signal sections are compressed by said second frequency components compressing means when said compression level judging means is operative to judge that said compression level for each of said sound signal sections exceeds said predetermined threshold compression value and said second state in which said frequency components for each of said sound signal sections are not compressed by said second frequency components compressing means when said compression level judging means is operative to judge that said compression level for each of said sound signal sections does not exceed said predetermined threshold compression value, said multiplexed bit stream with said predetermined bit rate being constituted by said sound signals for each of said sound signal sections and general information needed for said sound signals to be encoded and decoded.

3. A sound signal encoding apparatus for encoding two different sound signals, comprising:

sound signals dividing means for dividing each of said two different sound signals into a plurality of sound signal sections along a time axis for each of said sound signals to be taken for receiving therein, said sound signals consisting of a first channel signal and a second channel signal;

first sound signal sections analyzing means for analyzing each of said divided sound signal sections based on the sound signal characteristics inherent in said sound signal;

sampling rate selecting means for selecting one arbitrary sampling rate for each of said analyzed sound signal sections from among predetermined sampling rates;

sound signal sampling means for sampling each of said divided sound signal sections at said sampling rate selected by said sampling rate selecting means;

second sound signal sections analyzing means for analyzing each of said divided sound signal sections based on a psycho acoustic model obtained by taking advantage of human's hearing characteristics;

frequency components calculating means for calculating frequency components with two different information consisting of first and second signals for each of said sound signal sections sampled at said selected sampling rate, said above first signal being indicative of intensities, and said above second signal being indicative of frequencies;

quantization bit numbers allocating means for allocating quantization bit numbers for each of said calculated frequency components for each of said sound signal sections;

energy ratio calculating means for calculating an energy ratio for each of said sound signal sections;

energy ratio judging means for judging whether or not said energy ratio for each of said sound signal sections exceeds a predetermined threshold energy value;

first frequency components compressing means for compressing said frequency components for each of said sound signal sections with two different information consisting of first and second signals, said above first signal being indicative of said intensities and said above second signal being indicative of ratio of one of said frequency components for said first channel signal and said frequency components for said second channel signal to the other of said frequency components for said first channel signal and said frequency components for said second channel signal;

second frequency components compressing means for compressing said frequency components for each of said sound signal sections with two different information consisting of first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

frequency components quantizing means for quantizing each of said frequency components for each of said sound signal sections at predetermined quantization bit numbers under two different states consisting of a first state in which said frequency components for each of said sound signal sections are compressed by said first frequency components compressing means when said energy ratio judging means is operative to judge that said energy ratio for each of said sound signal sections exceeds said predetermined threshold energy value and a second state in which said frequency components for each of said sound signal sections are not compressed by said first frequency components compressing means when said energy ratio judging means is operative to judge that said energy ratio for each of said sound signal sections does not exceed said predetermined threshold energy value; and frequency components encoding means for encoding said quantized frequency components for each of said sound signal sections to a multiplexed bit stream with a predetermined bit rate under two different states consisting of said first state in which said frequency components for each of said sound signal sections are compressed by said first frequency components compressing means when said energy ratio judging means is operative to judge that said energy ratio for each of said sound signal sections exceeds said predetermined threshold energy value and said second state in which said frequency components for each of said sound signal sections are not compressed by said first frequency components compressing means when said energy ratio judging means is operative to judge that said energy ratio for each of said sound signal sections does not exceed said predetermined threshold energy value, said multiplexed bit stream with said predetermined bit rate being constituted by said sound signals for each of said sound signal sections and general information needed for said sound signals to be encoded and decoded.

4. A sound signal encoding apparatus for encoding two different sound signals, comprising:

sound signals dividing means for dividing each of said two different sound signals into a plurality of sound signal sections along a time axis for each of said sound signals to be taken for receiving therein, said sound signals consisting of a first channel signal and a second channel signal;

first sound signal sections analyzing means for analyzing each of said divided sound signal sections based on the sound signal characteristics inherent in said sound signal;

sampling rate selecting means for selecting one arbitrary sampling rate for each of said analyzed sound signal sections from among predetermined sampling rates;

sound signal sampling means for sampling each of said divided sound signal sections at said sampling rate selected by said sampling rate selecting means;

second sound signal sections analyzing means for analyzing each of said divided sound signal sections based on a psycho acoustic model obtained by taking advantage of human's hearing characteristics;

frequency components calculating means for calculating frequency components with two different information consisting of first and second signals for each of said sound signal sections sampled at said selected sampling rate, said above first signal being indicative of intensities, and said above second signal being indicative of frequencies;

quantization bit numbers allocating means for allocating quantization bit numbers for each of said calculated frequency components for each of said sound signal sections;

energy ratio calculating means for calculating an energy ratio for each of said sound signal sections;

energy ratio judging means for judging whether or not said energy ratio for each of said sound signal sections exceeds a predetermined threshold energy value;

first frequency components compressing means for compressing said frequency components for each of said sound signal sections with two different information consisting of first and second signals, said above first signal being indicative of said intensities and said above second signal being indicative of ratio of one of said frequency components for said first channel signal and said frequency components for said second channel signal to the other of said frequency components for said first channel signal and said frequency components for said second channel signal;

second frequency components compressing means for compressing said frequency components for each of said sound signal sections with two different information consisting of first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

frequency components quantizing means for quantizing each of said frequency components for each of said sound signal sections at predetermined quantization bit numbers under two different states consisting of a first state in which said frequency components for each of said sound signal sections are compressed by said second frequency components compressing means when said energy ratio judging means is operative to judge that said energy ratio for each of said sound signal sections exceeds said predetermined threshold energy value and a second state in which said frequency components for each of said sound signal sections are not compressed by said second frequency components compressing means when said energy ratio judging means is operative to judge that said energy ratio for each of said sound signal sections does not exceed said predetermined threshold energy value; and frequency components encoding means for encoding said quantized frequency components for each of said sound signal sections to a multiplexed bit stream with a predetermined bit rate under two different states consisting of said first state in which said frequency components for each of said sound signal sections are compressed by said second frequency components compressing means when said energy ratio judging means is operative to judge that said energy ratio for each of said sound signal sections exceeds said predetermined threshold energy value and said second state in which said frequency components for each of said sound signal sections are not compressed by said second frequency components compressing means when said energy ratio judging means is operative to judge that said energy ratio for each of said sound signal sections does not exceed said predetermined threshold energy value, said multiplexed bit stream with said predetermined bit rate being constituted by said sound signals for each of said sound signal sections and general information needed for said sound signals to be encoded and decoded.

5. A sound signal encoding apparatus for encoding two different sound signals, comprising:

sound signals dividing means for dividing each of said two different sound signals into a plurality of sound signal sections along a time axis for each of said sound signals to be taken for receiving therein, said sound signals consisting of a first channel signal and a second channel signal;

first sound signal sections analyzing means for analyzing each of said divided sound signal sections based on the sound signal characteristics inherent in said sound signal;

sampling rate selecting means for selecting one arbitrary sampling rate for each of said analyzed sound signal sections from among predetermined sampling rates;

sound signal sampling means for sampling each of said divided sound signal sections at said sampling rate selected by said sampling rate selecting means;

second sound signal sections analyzing means for analyzing each of said divided sound signal sections based on a psycho acoustic model obtained by taking advantage of human's hearing characteristics;

frequency components calculating means for calculating frequency components with two different information consisting of first and second signals for each of said sound signal sections sampled at said selected sampling rate, said above first signal being indicative of intensities, and said above second signal being indicative of frequencies;

quantization bit numbers allocating means for allocating quantization bit numbers for each of said calculated frequency components for each of said sound signal sections;

compression level calculating means for calculating a compression level for each of said sound signal sections;

threshold energy value selecting means for selecting one arbitrary threshold energy value for each of said sound signal sections from among predetermined threshold energy values based on said compression level calculated by said compression level calculating means;

energy ratio calculating means for calculating an energy ratio for each of said sound signal sections;

energy ratio judging means for judging whether or not said energy ratio for each of said sound signal sections exceeds said threshold energy value selected by said threshold energy value selecting means;

first frequency components compressing means for compressing said frequency components for each of said sound signal sections with two different information consisting of first and second signals, said above first signal being indicative of said intensities and said above second signal being indicative of ratio of one of said frequency components for said first channel signal and said frequency components for said second channel signal to the other of said frequency components for said first channel signal and said frequency components for said second channel signal;

second frequency components compressing means for compressing said frequency components for each of said sound signal sections with two different information consisting of first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

frequency components quantizing means for quantizing each of said frequency components for each of said sound signal sections at predetermined quantization bit numbers under two different states consisting of a first state in which said frequency components for each of said sound signal sections are compressed by said first frequency components compressing means when said energy ratio judging means is operative to judge that said energy ratio for each of said sound signal sections exceeds said selected threshold energy value and a second state in which said frequency components for each of said sound signal sections are not compressed by said first frequency components compressing means when said energy ratio judging means is operative to judge that said energy ratio for each of said sound signal sections does not exceed said selected threshold energy value; and frequency components encoding means for encoding said quantized frequency components for each of said sound signal sections to a multiplexed bit stream with a predetermined bit rate under two different states consisting of said first state in which said frequency components for each of said sound signal sections are compressed by said first frequency components compressing means when said energy ratio judging means is operative to judge that said energy ratio for each of said sound signal sections exceeds said selected threshold energy value and said second state in which said frequency components for each of said sound signal sections are not compressed by said first frequency components compressing means when said energy ratio judging means is operative to judge that said energy ratio for each of said sound signal sections does not exceed said selected threshold energy value, said multiplexed bit stream with said predetermined bit rate being constituted by said sound signals for each of said sound signal sections and general information needed for said sound signals to be encoded and decoded.

6. A sound signal encoding apparatus for encoding two different sound signals, comprising:

sound signals dividing means for dividing each of said two different sound signals into a plurality of sound signal sections along a time axis for each of said sound signals to be taken for receiving therein, said sound signals consisting of a first channel signal and a second channel signal;

first sound signal sections analyzing means for analyzing each of said divided sound signal sections based on the sound signal characteristics inherent in said sound signal;

sampling rate selecting means for selecting one arbitrary sampling rate for each of said analyzed sound signal sections from among predetermined sampling rates;

sound signal sampling means for sampling each of said divided sound signal sections at said sampling rate selected by said sampling rate selecting means;

second sound signal sections analyzing means for analyzing each of said divided sound signal sections based on a psycho acoustic model obtained by taking advantage of human's hearing characteristics;

frequency components calculating means for calculating frequency components with two different information consisting of first and second signals for each of said sound signal sections sampled at said selected sampling rate, said above first signal being indicative of intensities, and said above second signal being indicative of frequencies;

quantization bit numbers allocating means for allocating quantization bit numbers for each of said calculated frequency components for each of said sound signal sections;

compression level calculating means for calculating a compression level for each of said sound signal sections;

threshold energy value selecting means for selecting one arbitrary threshold energy value for each of said sound signal sections from among predetermined threshold energy values based on said compression level calculated by said compression level calculating means;

energy ratio calculating means for calculating an energy ratio for each of said sound signal sections;

energy ratio judging means for judging whether or not said energy ratio for each of said sound signal sections exceeds said threshold energy value selected by said threshold compression value selecting means;

first frequency components compressing means for compressing said frequency components for each of said sound signal sections with two different information consisting of first and second signals, said above first signal being indicative of said intensities and said above second signal being indicative of ratio of one of said frequency components for said first channel signal and said frequency components for said second channel signal to the other of said frequency components for said first channel signal and said frequency components for said second channel signal;

second frequency components compressing means for compressing said frequency components for each of said sound signal sections with two different information consisting of first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

frequency components quantizing means for quantizing each of said frequency components for each of said sound signal sections at predetermined quantization bit numbers under two different states consisting of a first state in which said frequency components for each of said sound signal sections are compressed by said second frequency components compressing means when said energy ratio judging means is operative to judge that said energy ratio for each of said sound signal sections exceeds said selected threshold energy value and a second state in which said frequency components for each of said sound signal sections are not compressed by said second frequency components compressing means when said energy ratio judging means is operative to judge that said energy ratio for each of said sound signal sections does not exceed said selected threshold energy value; and frequency components encoding means for encoding said quantized frequency components for each of said sound signal sections to a multiplexed bit stream with a predetermined bit rate under two different states consisting of said first state in which said frequency components for each of said sound signal sections are compressed by said second frequency components compressing means when said energy ratio judging means is operative to judge that said energy ratio for each of said sound signal sections exceeds said selected threshold energy value and said second state in which said frequency components for each of said sound signal sections are not compressed by said second frequency components compressing means when said energy ratio judging means is operative to judge that said energy ratio for each of said sound signal sections does not exceed said selected threshold energy value, said multiplexed bit stream with said predetermined bit rate being constituted by said sound signals for each of said sound signal sections and general information needed for said sound signals to be encoded and decoded.

7. A sound signal encoding apparatus as set forth in claim 1, in which said compression level calculating means is operative to calculate said compression level for each of said sound signal sections with the compression ratio of said selected sampling rate to said predetermined bit rate at which said multiplexed bit stream is outputted by said frequency components encoding means.

8. A sound signal encoding apparatus as set forth in claim 3, in which said energy ratio calculating means is operative to calculate five different information consisting of first to fifth signal; said above first signal is indicative of the addition of each of said frequency components for said first channel signal and each of said frequency components for said second channel signal; said above second signal being indicative of the difference between each of said frequency components for said first channel signal and each of said frequency components for said second channel signal; said above third signal is indicative of said energy level with said above first signal; said above fourth signal is indicative of said energy level with said above second signal; and said above fifth signal is indicative of the energy ratio of said above third signal to said above fourth signal.

9. A sound signal delivery system, comprises: a sound signal encoding apparatus as set forth in claim 1, a server unit for accumulating the sound signals encoded by the sound signal encoding apparatus, a plurality of terminal units for requesting said sound signals encoded by the sound signal encoding apparatus, and a network between said server unit and said terminal units to have said server unit and said terminal units electrically connected to each other, said sever unit being operative to deliver said sound signals encoded by the sound signal encoding apparatus to said terminal units through said network when said terminal units are operative to request said sever unit to deliver said sound signals encoded by the sound signal encoding apparatus to said terminal units.

10. A sound signal encoding method for encoding two different sound signals, comprising:

a sound signals dividing step of dividing each of said two different sound signals into a plurality of sound signal sections along a time axis for each of said sound signals to be taken for receiving therein, said sound signals consisting of a first channel signal and a second channel signal;

a first sound signal sections analyzing step of analyzing each of said divided sound signal sections based on the sound signal characteristics inherent in said sound signal;

a sampling rate selecting step of selecting one arbitrary sampling rate for each of said analyzed sound signal sections from among predetermined sampling rates;

a sound signal sampling step of sampling each of said analyzed sound signal sections at said sampling rate selected by said sampling rate selecting step;

a second sound signal sections analyzing step of analyzing each of said divided sound signal sections based on a psycho acoustic model obtained by taking advantage of human's hearing characteristics;

a frequency components calculating step of calculating frequency components with two different information consisting of first and second signals for each of said sound signal sections sampled at said selected sampling rate, said above first signal being indicative of intensifies, and said above second signal being indicative of frequencies;

a quantization bit numbers allocating step of allocating quantization bit numbers for each of said calculated frequency components for each of said sound signal sections;

a compression level calculating step of calculating a compression level for each of said sound signal sections;

a compression level judging step of judging whether or not said compression level for each of said sound signal sections exceeds said predetermined threshold compression value;

a first frequency components compressing step of compressing said frequency components for each of said sound signal sections with said two different information consisting of said first and second signals, said above first signal being indicative of said intensity and said above second signal being indicative of ratio of one of said frequency components for said first channel signal and said frequency components for said second channel signal to the other of said frequency components for said first channel signal and said frequency components for said second channel signal;

a second frequency components compressing step of compressing said frequency components for each of said sound signal sections with two different information consisting of said first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

a frequency components quantizing step of quantizing each of said frequency components for each of said sound signal sections at said predetermined quantization bit numbers under said two different states consisting of said first state in which said frequency components for each of said sound signal sections are compressed by said first frequency components compressing step when said compression level judging step is operative to judge that said compression level for each of said sound signal sections exceeds said predetermined threshold compression value and said second state in which said frequency components for each of said sound signal sections are not compressed by said first frequency components compressing step when said compression level judging step is operative to judge that said compression level for each of said sound signal sections does not exceed said predetermined threshold compression value; and a frequency components encoding step of encoding said quantized frequency components for each of said sound signal sections to said multiplexed bit stream with said predetermined bit rate under said two different states consisting of said first state in which said frequency components for each of said sound signal sections are compressed by said first frequency components compressing step when said compression level judging step is operative to judge that said compression level for each of said sound signal sections exceeds said predetermined threshold compression value and said second state in which said frequency components for each of said sound signal sections are not compressed by said first frequency components compressing step when said compression level judging step is operative to judge that said compression level for each of said sound signal sections does not exceed said predetermined threshold compression value, said multiplexed bit stream with said predetermined bit rate being constituted by said sound signals for each of said sound signal sections and general information needed for said sound signals to be encoded and decoded.

11. A sound signal encoding method for encoding two different sound signals, comprising:

a sound signals dividing step of dividing each of said two different sound signals into a plurality of sound signal sections along a time axis for each of said sound signals to be taken for receiving therein, said sound signals consisting of said first channel signal and said second channel signal;

a first sound signal sections analyzing step of analyzing each of said divided sound signal sections based on the sound signal characteristics inherent in said sound signal;

a sampling rate selecting step of selecting one arbitrary sampling rate for each of said analyzed sound signal sections from among predetermined sampling rates;

a sound signal sampling step of sampling each of said divided sound signal sections at said sampling rate selected by said sampling rate selecting step;

a second sound signal sections analyzing step of analyzing each of said divided sound signal sections based on said psycho acoustic model obtained by taking advantage of human's hearing characteristics;

a frequency components calculating step of calculating frequency components with two different information consisting of first and second signals for each of said sound signal sections sampled at said selected sampling rate, said above first signal being indicative of intensities, and said above second signal being indicative of frequencies;

a quantization bit numbers allocating step of allocating said quantization bit numbers for each of said calculated frequency components for each of said sound signal sections;

a compression level calculating step of calculating a compression level for each of said sound signal sections;

a compression level judging step of judging whether or not said compression level for each of said sound signal sections exceeds said predetermined threshold compression value;

a first frequency components compressing step of compressing said frequency components for each of said sound signal sections with said two different information consisting of said first and second signals, said above first signal being indicative of said intensity and said above second signal being indicative of ratio of one of said frequency components for said first channel signal and said frequency components for said second channel signal to the other of said frequency components for said first channel signal and said frequency components for said second channel signal;

a second frequency components compressing step of compressing said frequency components for each of said sound signal sections with said two different information consisting of said first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

a frequency components quantizing step of quantizing each of said frequency components for each of said sound signal sections at said predetermined quantization bit numbers under said two different states consisting of said first state in which said frequency components for each of said sound signal sections are compressed by said second frequency components compressing step when said compression level judging step is operative to judge that said compression level for each of said sound signal sections exceeds said predetermined threshold compression value and said second state in which said frequency components for each of said sound signal sections are not compressed by said second frequency components compressing step when said compression level judging step is operative to judge that said compression level for each of said sound signal sections does not exceed said predetermined threshold compression value; and a frequency components encoding step of encoding said quantized frequency components for each of said sound signal sections to said multiplexed bit stream with said predetermined bit rate under said two different states consisting of said first state in which said frequency components for each of said sound signal sections are compressed by said second frequency components compressing step when said compression level judging step is operative to judge that said compression level for each of said sound signal sections exceeds said predetermined threshold compression value and said second state in which said frequency components for each of said sound signal sections are not compressed by said second frequency components compressing step when said compression level judging step is operative to judge that said compression level for each of said sound signal sections does not exceed said predetermined threshold compression value, said multiplexed bit stream with said predetermined bit rate being constituted by said sound signals for each of said sound signal sections and general information needed for said sound signals to be encoded and decoded.

12. A sound signal encoding method for encoding two different sound signals, comprising:

a sound signals dividing step of dividing each of said two different sound signals into a plurality of sound signal sections along a time axis for each of said sound signals to be taken for receiving therein, said sound signals consisting of said first channel signal and said second channel signal;

a first sound signal sections analyzing step of analyzing each of said divided sound signal sections based on the sound signal characteristics inherent in said sound signal;

a sampling rate selecting step of selecting said one arbitrary sampling rate for each of said sound signal sections from among said predetermined sampling rates based on each of said sound signal sections analyzed by said first sound signal analyzing step;

a sound signal sampling step of sampling each of said divided sound signal sections at said sampling rate selected by said sampling rate selecting step;

a second sound signal sections analyzing step of analyzing each of said divided sound signal sections based on said psycho acoustic model obtained by taking advantage of human's hearing characteristics;

a frequency components calculating step of calculating frequency components with two different information consisting of first and second signals for each of said sound signal sections sampled at said selected sampling rate, said above first signal being indicative of intensities, and said above second signal being indicative of frequencies;

a quantization bit numbers allocating step of allocating said quantization bit numbers for each of said calculated frequency components for each of said sound signal sections;

an energy ratio calculating step of calculating an energy ratio for each of said sound signal sections;

an energy ratio judging step of judging whether or not said energy ratio for each of said sound signal sections exceeds said predetermined threshold energy value;

a first frequency components compressing step of compressing said frequency components for each of said sound signal sections with said two different information consisting of said first and second signals, said above first signal being indicative of said intensity and said above second signal being indicative of ratio of one of said frequency components for said first channel signal and said frequency components for said second channel signal to the other of said frequency components for said first channel signal and said frequency components for said second channel signal;

a second frequency components compressing step of compressing said frequency components for each of said sound signal sections with said two different information consisting of said first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

a frequency components quantizing step of quantizing each of said frequency components for each of said sound signal sections at said predetermined quantization bit numbers under said two different states consisting of said first state in which said frequency components for each of said sound signal sections are compressed by said first frequency components compressing step when said energy ratio judging step is operative to judge that said energy ratio for each of said sound signal sections exceeds said predetermined threshold energy value and said second state in which said frequency components for each of said sound signal sections are not compressed by said first frequency components compressing step when said energy ratio judging step is operative to judge that said energy ratio for each of said sound signal sections does not exceed said predetermined threshold energy value; and a frequency components encoding step of encoding said quantized frequency components for each of said sound signal sections to said multiplexed bit stream with said predetermined bit rate under said two different states consisting of said first state in which said frequency components for each of said sound signal sections are compressed by said first frequency components compressing step when said energy ratio judging step is operative to judge that said energy ratio for each of said sound signal sections exceeds said predetermined threshold energy value and said second state in which said frequency components for each of said sound signal sections are not compressed by said first frequency components compressing step when said energy ratio judging step is operative to judge that said energy ratio for each of said sound signal sections does not exceed said predetermined threshold energy value, said multiplexed bit stream with said predetermined bit rate being constituted by said sound signals for each of said sound signal sections and general information needed for said sound signals to be encoded and decoded.

13. A sound signal encoding method for encoding two different sound signals, comprising:

a sound signals dividing step of dividing each of said two different sound signals into a plurality of sound signal sections along a time axis for each of said sound signals to be taken for receiving therein, said sound signals consisting of said first channel signal and said second channel signal;

a first sound signal sections analyzing step of analyzing each of said divided sound signal sections based on the sound signal characteristics inherent in said sound signal;

a sampling rate selecting step of selecting one arbitrary sampling rate for each of said sound signal sections from among said predetermined sampling rates based on each of said sound signal sections analyzed by said first sound signal analyzing step;

a sound signal sampling step of sampling each of said divided sound signal sections at said sampling rate selected by said sampling rate selecting step;

a second sound signal sections analyzing step of analyzing each of said divided sound signal sections based on said psycho acoustic model obtained by taking advantage of human's hearing characteristics;

a frequency components calculating step of calculating frequency components with two different information consisting of first and second signals for each of said sound signal sections sampled at said selected sampling rate, said above first signal being indicative of intensities, and said above second signal being indicative of frequencies;

a quantization bit numbers allocating step of allocating quantization bit numbers for each of said calculated frequency components for each of said sound signal sections;

an energy ratio calculating step of calculating an energy ratio for each of said sound signal sections;

an energy ratio judging step of judging whether or not said energy ratio for each of said sound signal sections exceeds said predetermined threshold energy value;

a first frequency components compressing step of compressing said frequency components for each of said sound signal sections with said two different information consisting of said first and second signals, said above first signal being indicative of said intensity and said above second signal being indicative of ratio of one of said frequency components for said first channel signal and said frequency components for said second channel signal to the other of said frequency components for said first channel signal and said frequency components for said second channel signal;

a second frequency components compressing step of compressing said frequency components for each of said sound signal sections with said two different information consisting of said first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

a frequency components quantizing step of quantizing each of said frequency components for each of said sound signal sections at said predetermined quantization bit numbers under said two different states consisting of said first state in which said frequency components for each of said sound signal sections are compressed by said second frequency components compressing step when said energy ratio judging step is operative to judge that said energy ratio for each of said sound signal sections exceeds said predetermined threshold energy value and said second state in which said frequency components for each of said sound signal sections are not compressed by said second frequency components compressing step when said energy ratio judging step is operative to judge that said energy ratio for each of said sound signal sections does not exceed said predetermined threshold energy value; and a frequency components encoding step of encoding said quantized frequency components for each of said sound signal sections to said multiplexed bit stream with said predetermined bit rate under said two different states consisting of said first state in which said frequency components for each of said sound signal sections are compressed by said second frequency components compressing step when said energy ratio judging step is operative to judge that said energy ratio for each of said sound signal sections exceeds said predetermined threshold energy value and said second state in which said frequency components for each of said sound signal sections are not compressed by said second frequency components compressing step when said energy ratio judging step is operative to judge that said energy ratio for each of said sound signal sections does not exceed said predetermined threshold energy value, said multiplexed bit stream with said predetermined bit rate being constituted by said sound signals for each of said sound signal sections and general information needed for said sound signals to be encoded and decoded.

14. A sound signal encoding method for encoding two different sound signals, comprising:

a sound signals dividing step of dividing each of said two different sound signals into a plurality of sound signal sections along a time axis for each of said sound signals to be taken for receiving therein, said sound signals consisting of said first channel signal and said second channel signal;

a first sound signal sections analyzing step of analyzing each of said divided sound signal sections based on the sound signal characteristics inherent in said sound signal;

a sampling rate selecting step of selecting said one arbitrary sampling rate for each of said sound signal sections from among said predetermined sampling rates based on each of said sound signal sections analyzed by said first sound signal analyzing step;

a sound signal sampling step of sampling each of said divided sound signal sections at said sampling rate selected by said sampling rate selecting step;

a second sound signal sections analyzing step of analyzing each of said divided sound signal sections based on said psycho acoustic model obtained by taking advantage of human's hearing characteristics;

a frequency components calculating step of calculating frequency components with two different information consisting of first and second signals for each of said sound signal sections sampled at said selected sampling rate, said above first signal being indicative of intensities, and said above second signal being indicative of frequencies;

a quantization bit numbers allocating step of allocating quantization bit numbers for each of said calculated frequency components for each of said sound signal sections;

a compression level calculating step of calculating a compression level for each of said sound signal sections;

a threshold energy value selecting step of selecting said one arbitrary threshold energy value for each of said sound signal sections from among said predetermined threshold energy values based on said compression level calculated by said compression level calculating step;

an energy ratio calculating step of calculating an energy ratio for each of said sound signal sections;

an energy ratio judging step of judging whether or not said energy ratio for each of said sound signal sections exceeds said threshold energy value selected by said threshold energy value selecting step;

a first frequency components compressing step of compressing said frequency components for each of said sound signal sections with said two different information consisting of said first and second signals, said above first signal being indicative of said intensity and said above second signal being indicative of ratio of one of said frequency components for said first channel signal and said frequency components for said second channel signal to the other of said frequency components for said first channel signal and said frequency components for said second channel signal;

a second frequency components compressing step of compressing said frequency components for each of said sound signal sections with said two different information consisting of said first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

a frequency components quantizing step of quantizing each of said frequency components for each of said sound signal sections at said predetermined quantization bit numbers under said two different states consisting of said first state in which said frequency components for each of said sound signal sections are compressed by said first frequency components compressing step when said energy ratio judging step is operative to judge that said energy ratio for each of said sound signal sections exceeds said selected threshold energy value and said second state in which said frequency components for each of said sound signal sections are not compressed by said first frequency components compressing step when said energy ratio judging step is operative to judge that said energy ratio for each of said sound signal sections does not exceed said selected threshold energy value; and a frequency components encoding step of encoding said quantized frequency components for each of said sound signal sections to said multiplexed bit stream with said predetermined bit rate under two different states consisting of said first state in which said frequency components for each of said sound signal sections are compressed by said first frequency components compressing step when said energy ratio judging step is operative to judge that said energy ratio for each of said sound signal sections exceeds said selected threshold energy value and said second state in which said frequency components for each of said sound signal sections are not compressed by said first frequency components compressing step when said energy ratio judging step is operative to judge that said energy ratio for each of said sound signal sections does not exceed said selected threshold energy value, said multiplexed bit stream with said predetermined bit rate being constituted by said sound signals for each of said sound signal sections and general information needed for said sound signals to be encoded and decoded.

15. A sound signal encoding method for encoding two different sound signals, comprising:

a sound signals dividing step of dividing each of said two different sound signals into a plurality of sound signal sections along a time axis for each of said sound signals to be taken for receiving therein, said sound signals consisting of said first channel signal and said second channel signal;

a first sound signal sections analyzing step of analyzing each of said divided sound signal sections based on the sound signal characteristics inherent in said sound signal;

a sampling rate selecting step of selecting said one arbitrary sampling rate for each of said sound signal sections from among said predetermined sampling rates based on each of said sound signal sections analyzed by said first sound signal analyzing step;

a sound signal sampling step of sampling each of said divided sound signal sections at said sampling rate selected by said sampling rate selecting step;

a second sound signal sections analyzing step of analyzing each of said divided sound signal sections based on said psycho acoustic model obtained by taking advantage of human's hearing characteristics;

a frequency components calculating step of calculating frequency components with two different information consisting of first and second signals for each of said sound signal sections sampled at said selected sampling rate, said above first signal being indicative of intensities, and said above second signal being indicative of frequencies;

a quantization bit numbers allocating step of allocating quantization bit numbers for each of said calculated frequency components for each of said sound signal sections;

a compression level calculating step of calculating said compression level for each of said sound signal sections;

a threshold energy value selecting step of selecting said one arbitrary threshold energy value for each of said sound signal sections from among said predetermined threshold energy values based on said compression level calculated by said compression level calculating step;

an energy ratio calculating step of calculating said energy ratio for each of said sound signal sections;

an energy ratio judging step of judging whether or not said energy ratio for each of said sound signal sections exceeds said threshold energy value selected by said threshold compression value selecting step;

a first frequency components compressing step of compressing said frequency components for each of said sound signal sections with said two different information consisting of said first and second signals, said above first signal being indicative of said intensity and said above second signal being indicative of ratio of one of said frequency components for said first channel signal and said frequency components for said second channel signal to the other of said frequency components for said first channel signal and said frequency components for said second channel signal;

a second frequency components compressing step of compressing said frequency components for each of said sound signal sections with said two different information consisting of said first and second signals, said above first signal being indicative of the addition of each of said frequency components for said first channel signal and each of said frequency components for said second channel signal, and said above second signal being indicative of the difference between each of said frequency components for said first channel signal and each of said frequency components for said second channel signal;

a frequency components quantizing step of quantizing each of said frequency components for each of said sound signal sections at said predetermined quantization bit numbers under said two different states consisting of said first state in which said frequency components for each of said sound signal sections are compressed by said second frequency components compressing step when said energy ratio judging step is operative to judge that said energy ratio for each of said sound signal sections exceeds said selected threshold energy value and said second state in which said frequency components for each of said sound signal sections are not compressed by said second frequency components compressing step when said energy ratio judging step is operative to judge that said energy ratio for each of said sound signal sections does not exceed said selected threshold energy value; and a frequency components encoding step of encoding said quantized frequency components for each of said sound signal sections to said multiplexed bit stream with said predetermined bit rate under two different states consisting of said first state in which said frequency components for each of said sound signal sections are compressed by said second frequency components compressing step when said energy ratio judging step is operative to judge that said energy ratio for each of said sound signal sections exceeds said selected threshold energy value and said second state in which said frequency components for each of said sound signal sections are not compressed by said second frequency components compressing step when said energy ratio judging step is operative to judge that said energy ratio for each of said sound signal sections does not exceed said selected threshold energy value, said multiplexed bit stream with said predetermined bit rate being constituted by said sound signals for each of said sound signal sections and general information needed for said sound signals to be encoded and decoded.

16. A sound signal encoding method as set forth in claim 1, in which said compression level calculating step is of calculating said compression level for each of said sound signal sections with said compression ratio of said selected sampling rate to said predetermined bit rate at which said multiplexed bit stream is outputted by said frequency components encoding step.

17. A sound signal encoding method as set forth in claim 3, in which said energy ratio calculating step is of calculating five different information consisting of first, second, third, fourth, and fifth signal; said above first signal is indicative of the addition of each of said frequency components for said first channel signal and each of said frequency components for said second channel signal; said above second signal being indicative of the difference between each of said frequency components for said first channel signal and each of said frequency components for said second channel signal; said above third signal is indicative of said energy level with said above first signal; said above fourth signal is indicative of said energy level with said above second signal; and said above fifth signal is indicative of the energy ratio of said above third signal to said above fourth signal.

* * * * *